US010071293B2

(12) United States Patent
Green

(10) Patent No.: US 10,071,293 B2
(45) Date of Patent: Sep. 11, 2018

(54) GOLF PUTTER HEADS

(71) Applicant: Green Golf LLC, Kennewick, WA (US)

(72) Inventor: Timothy M. Green, Kennewick, WA (US)

( * ) Notice: Subject to any disclaimer, the term of this patent is extended or adjusted under 35 U.S.C. 154(b) by 0 days.

(21) Appl. No.: 15/349,403

(22) Filed: Nov. 11, 2016

(65) Prior Publication Data

US 2017/0136322 A1 May 18, 2017

Related U.S. Application Data

(60) Provisional application No. 62/254,286, filed on Nov. 12, 2015.

(51) Int. Cl.

| | |
|---|---|
| ***A63B 53/04*** | (2015.01) |
| ***A63B 53/06*** | (2015.01) |
| ***A63B 53/00*** | (2015.01) |
| ***A63B 60/42*** | (2015.01) |
| ***A63B 60/02*** | (2015.01) |
| *A63B 102/32* | (2015.01) |

(52) U.S. Cl.

CPC ..... *A63B 53/065* (2013.01); *A63B 53/007* (2013.01); *A63B 53/0487* (2013.01); *A63B 60/02* (2015.10); *A63B 60/42* (2015.10); *A63B 2053/0491* (2013.01); *A63B 2102/32* (2015.10)

(58) Field of Classification Search

USPC ..... 473/324–350

See application file for complete search history.

(56) References Cited

U.S. PATENT DOCUMENTS

| | | | | |
|---|---|---|---|---|
| 2,517,245 A * | 8/1950 | Scott | A63B 53/04 | 473/339 |
| 3,199,874 A * | 8/1965 | Blasing | A63B 49/00 | 473/244 |
| 4,010,958 A * | 3/1977 | Long | A63B 53/0487 | 172/371 |
| 4,602,787 A | 7/1986 | Sugioka et al. | | |
| 5,388,827 A * | 2/1995 | Reynolds, Jr. | A63B 53/02 | 473/288 |
| 5,447,309 A * | 9/1995 | Vincent | A63B 53/04 | 473/335 |
| 5,533,725 A * | 7/1996 | Reynolds, Jr. | A63B 53/02 | 473/307 |

(Continued)

FOREIGN PATENT DOCUMENTS

| | | |
|---|---|---|
| JP | 10192461 A * | 7/1998 |
| JP | 11319167 A * | 11/1999 |

(Continued)

OTHER PUBLICATIONS

Happy Putter; The Adjustable Putter, www.brainstormgolf.com, Copyright 2016, 28 pages.

(Continued)

*Primary Examiner* — Alvin Hunter

(74) *Attorney, Agent, or Firm* — Harness, Dickey & Pierce, P.L.C.; Anthony G. Fussner

(57) ABSTRACT

According to various aspects, exemplary embodiments are disclosed of golf putter heads having customizable centers of gravity that are adjustable in three dimensions. Also disclosed are exemplary embodiments of methods of adjusting a center of gravity of a golf putter head.

17 Claims, 29 Drawing Sheets

(56) References Cited

U.S. PATENT DOCUMENTS

| | | | | | |
|---|---|---|---|---|---|
| 5,683,309 | A * | 11/1997 | Reimers | A63B 53/04 | 473/337 |
| 5,746,664 | A * | 5/1998 | Reynolds, Jr. | A63B 53/02 | 473/252 |
| 5,916,042 | A * | 6/1999 | Reimers | A63B 53/04 | 473/334 |
| 5,924,938 | A * | 7/1999 | Hines | A63B 53/02 | 473/307 |
| 6,089,994 | A * | 7/2000 | Sun | A63B 53/04 | 473/338 |
| 6,638,181 | B1 * | 10/2003 | Norman, III | A63B 53/0487 | 473/330 |
| D483,426 | S | 12/2003 | Green | | |
| D483,825 | S | 12/2003 | Green | | |
| D494,239 | S | 8/2004 | Green | | |
| 6,896,625 | B2 * | 5/2005 | Grace | A63B 53/0487 | 473/251 |
| 7,309,297 | B1 * | 12/2007 | Solari | A63B 53/04 | 473/256 |
| 7,354,355 | B2 * | 4/2008 | Tavares | A63B 53/04 | 473/329 |
| 7,384,345 | B2 * | 6/2008 | Sherman | A63B 53/0487 | 473/249 |
| 7,491,131 | B2 * | 2/2009 | Vinton | A63B 53/0487 | 473/251 |
| 7,758,451 | B2 * | 7/2010 | Liang | A63B 53/0487 | 473/334 |
| 8,308,583 | B2 * | 11/2012 | Morris | A63B 53/0487 | 473/335 |
| 8,414,413 | B2 * | 4/2013 | Franklin | A63B 53/0487 | 473/251 |
| 8,414,422 | B2 * | 4/2013 | Peralta | A63B 53/0466 | 473/334 |
| 8,721,472 | B2 * | 5/2014 | Kuan | A63B 53/0487 | 473/338 |
| 9,162,120 | B2 * | 10/2015 | Jertson | A63B 53/04 | |
| 9,302,160 | B2 * | 4/2016 | Song | A63B 60/00 | |
| 9,636,556 | B2 * | 5/2017 | Beck | A63B 53/06 | |
| 2003/0130059 | A1 | 7/2003 | Billings | | |
| 2004/0229707 | A1 * | 11/2004 | Lin | A63B 53/0466 | 473/238 |
| 2005/0037854 | A1 | 2/2005 | Green | | |
| 2005/0075185 | A1 | 4/2005 | Green | | |
| 2005/0181889 | A1 | 8/2005 | Green | | |
| 2006/0240908 | A1 * | 10/2006 | Adams | A63B 53/0466 | 473/334 |
| 2007/0142123 | A1 | 6/2007 | Franklin | | |
| 2008/0161715 | A1 | 7/2008 | Stivoric et al. | | |

FOREIGN PATENT DOCUMENTS

| | | | | |
|---|---|---|---|---|
| JP | 2001246031 | A * | 9/2001 | |
| JP | 2002272884 | A * | 9/2002 | |
| JP | 2003236025 | A * | 8/2003 | |
| JP | 2004081241 | A * | 3/2004 | |
| JP | 2005046442 | A * | 2/2005 | |
| JP | 2005160691 | A * | 6/2005 | |
| JP | 2006198385 | A * | 8/2006 | |
| JP | 2006288793 | A * | 10/2006 | |
| JP | 2007222257 | A * | 9/2007 | |
| JP | 2007236943 | A * | 9/2007 | A63B 53/0487 |
| JP | 2008173314 | A * | 7/2008 | |
| JP | 2011005166 | A * | 1/2011 | |
| JP | 2011005167 | A * | 1/2011 | A63B 53/0466 |
| JP | 2011125623 | A * | 6/2011 | A63B 53/0466 |
| WO | WO 2010028118 | A2 * | 3/2010 | A63B 53/04 |

OTHER PUBLICATIONS

Hybrid Putter Review by GRG, www.thomasgolf.com/pages/hybrid-putter-review-by-grg/, accessed Nov. 10, 2016, 1 page.

Adjustable Centre of Gravity Putter, http://www.lynxgolf.co.uk/unisixproducts/adjustable-centre-of-gravity-putter-cog1/, Copyright 2016, 2 pages.

* cited by examiner

GOLF PUTTER HEADS

CROSS-REFERENCE TO RELATED APPLICATION

This application claims the benefit of U.S. Provisional Application No. 62/254,286, filed Nov. 12, 2015. The entire disclosure of the above application is incorporated herein by reference.

FIELD

The present disclosure generally relates to golf putter heads.

BACKGROUND

This section provides background information related to the present disclosure which is not necessarily prior art.

Golf enthusiasts and equipment manufacturers have continually sought to improve golf clubs for many years. These efforts have included the addition of structures to improve the play of the clubs and structures designed as teaching aids to assist in instruction and use of particular clubs.

DRAWINGS

The drawings described herein are for illustrative purposes only of selected embodiments and not all possible implementations, and are not intended to limit the scope of the present disclosure.

FIG. 22 is an exploded perspective view of the golf putter head shown in

Figure 18:
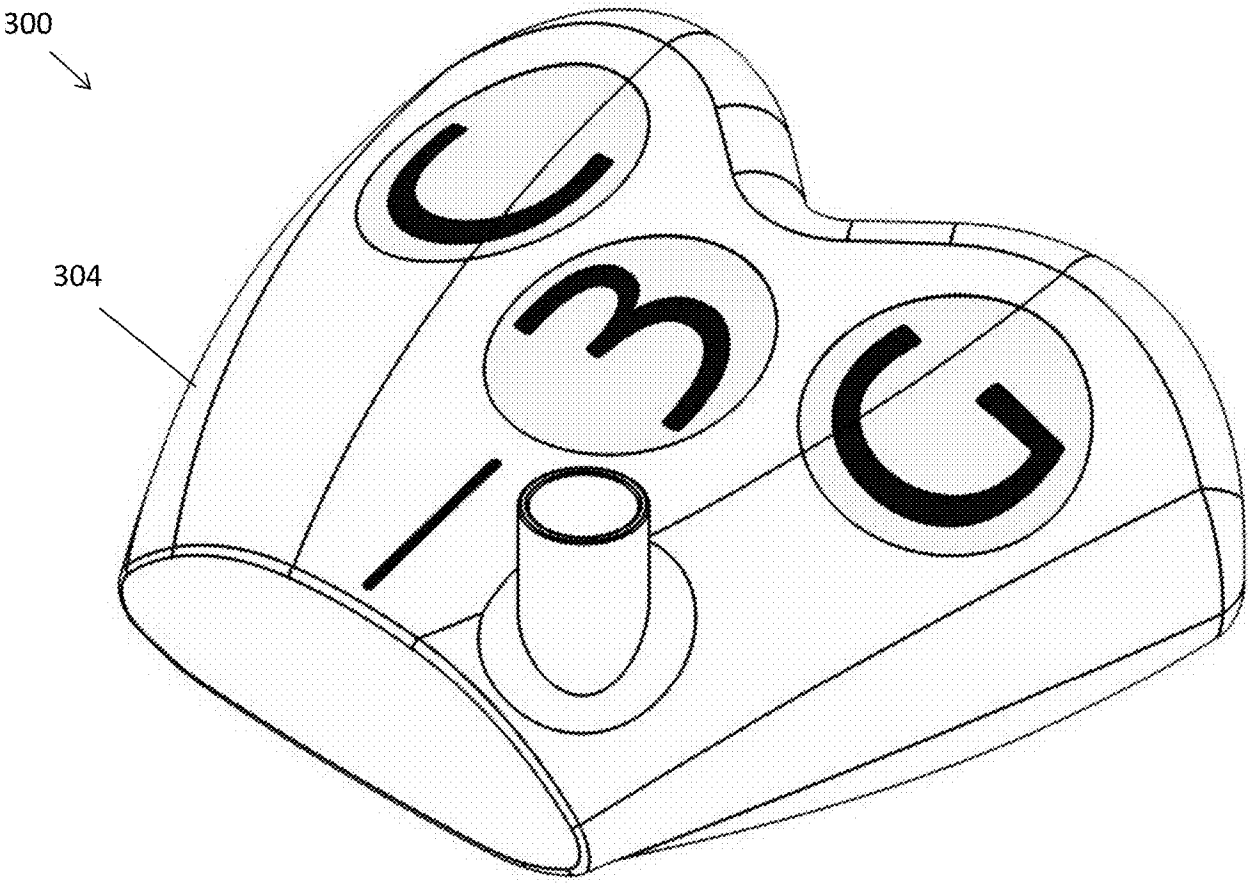
FIG. 18 is a perspective view of a golf putter head having a customizable center of gravity that is adjustable in three dimensions according to a second exemplary embodiment.
Figure 19:
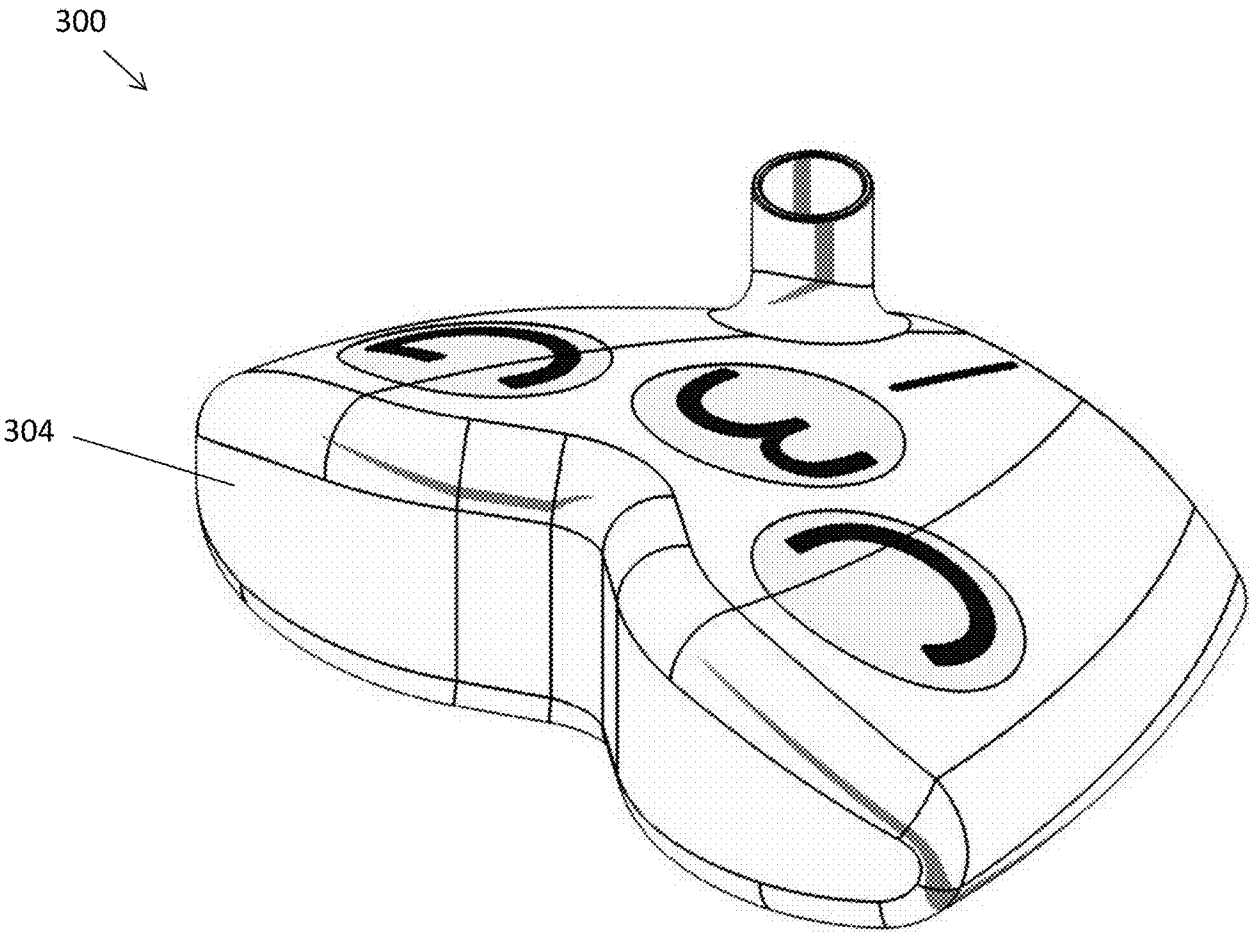
FIG. 19 is a back perspective view of the golf putter head shown in FIG. 18.
Figure 20:
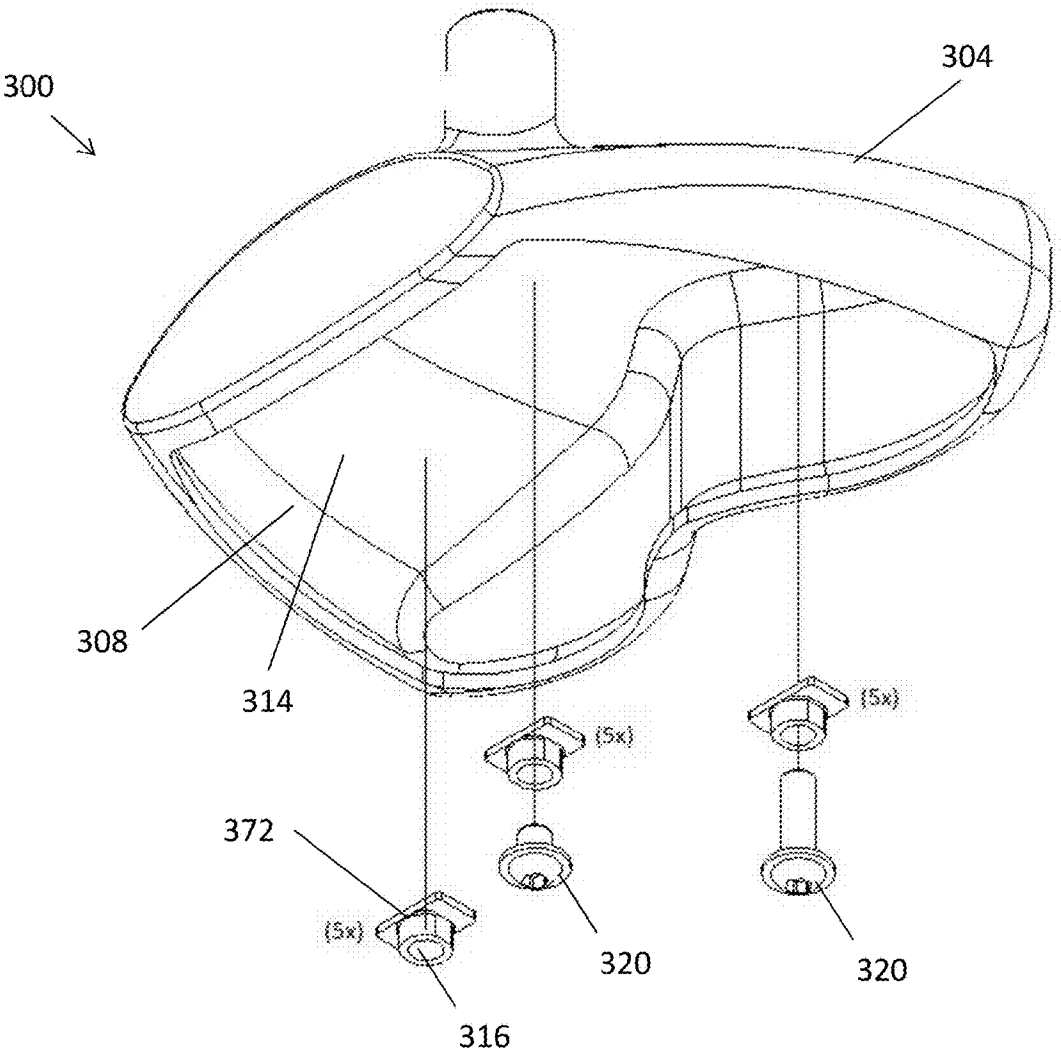
FIGS. 20 and 21 are exploded perspective views of the golf putter head shown in FIG. 18, and showing features that allow adjustment to the center of gravity of the golf putter head aligned for positioning within a hollow interior or cavity of the golf putter head.
Figure 21:
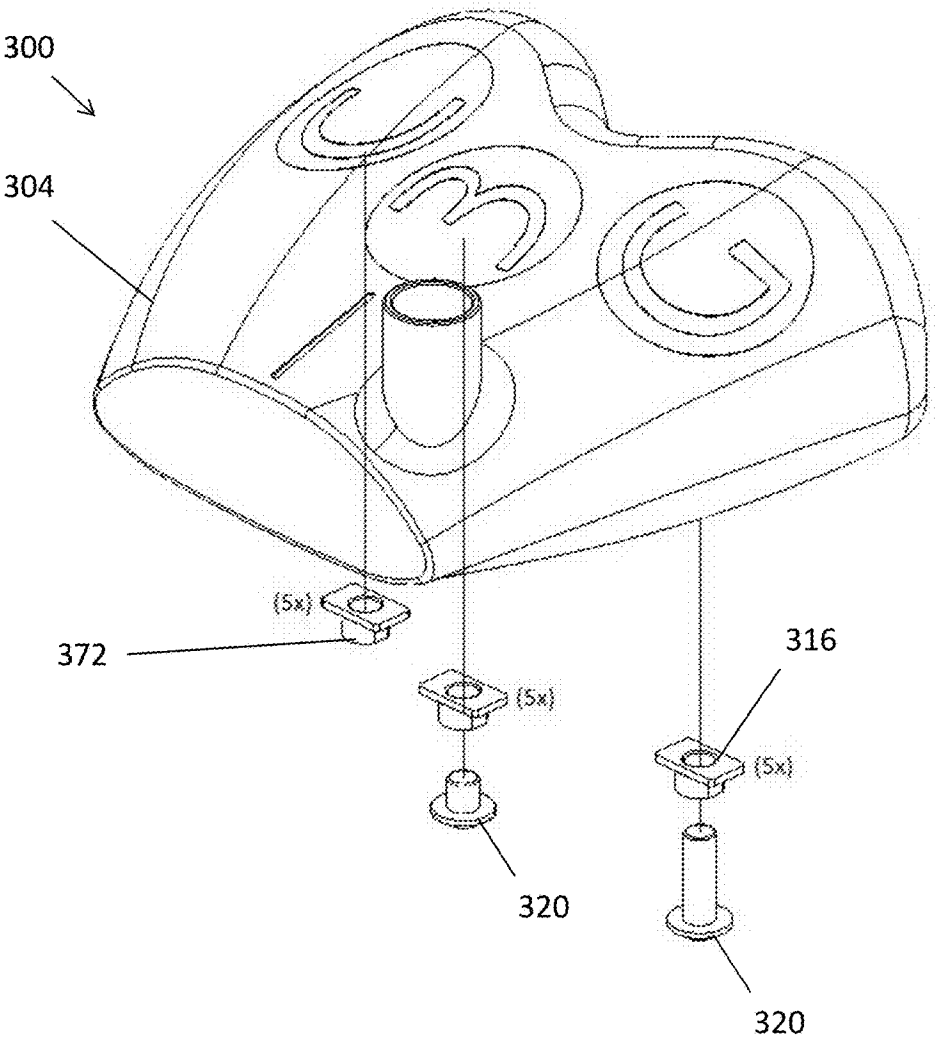
Figure 22:
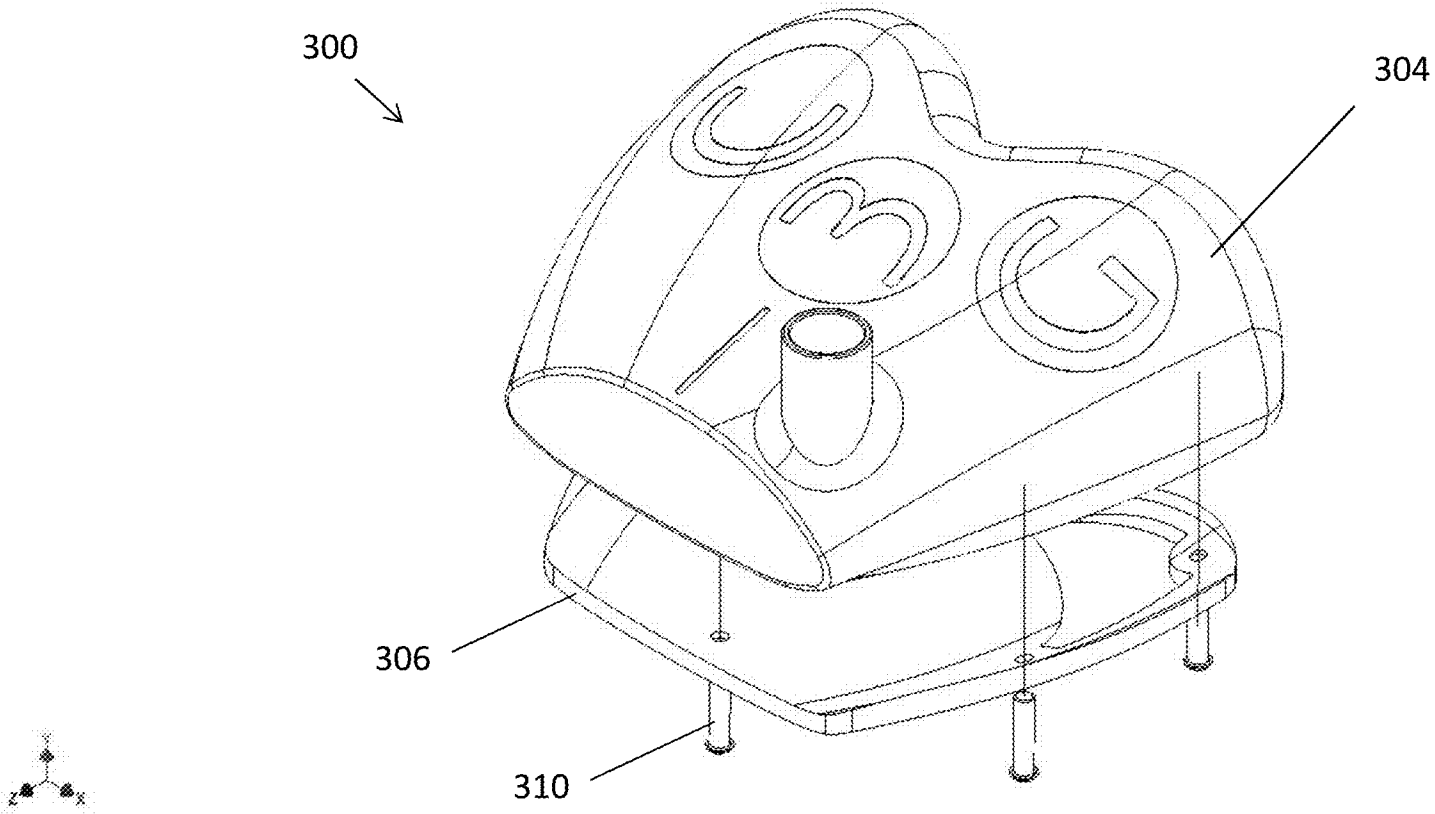
Figure 23:
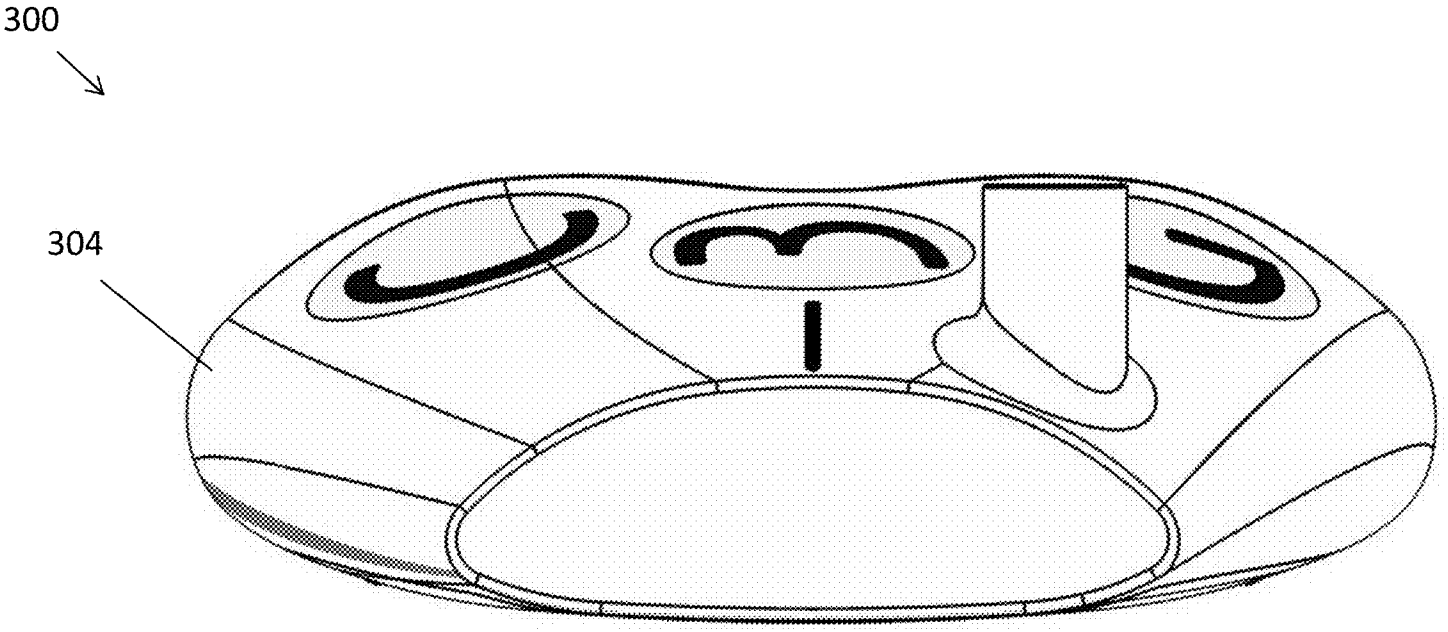
Figure 24:
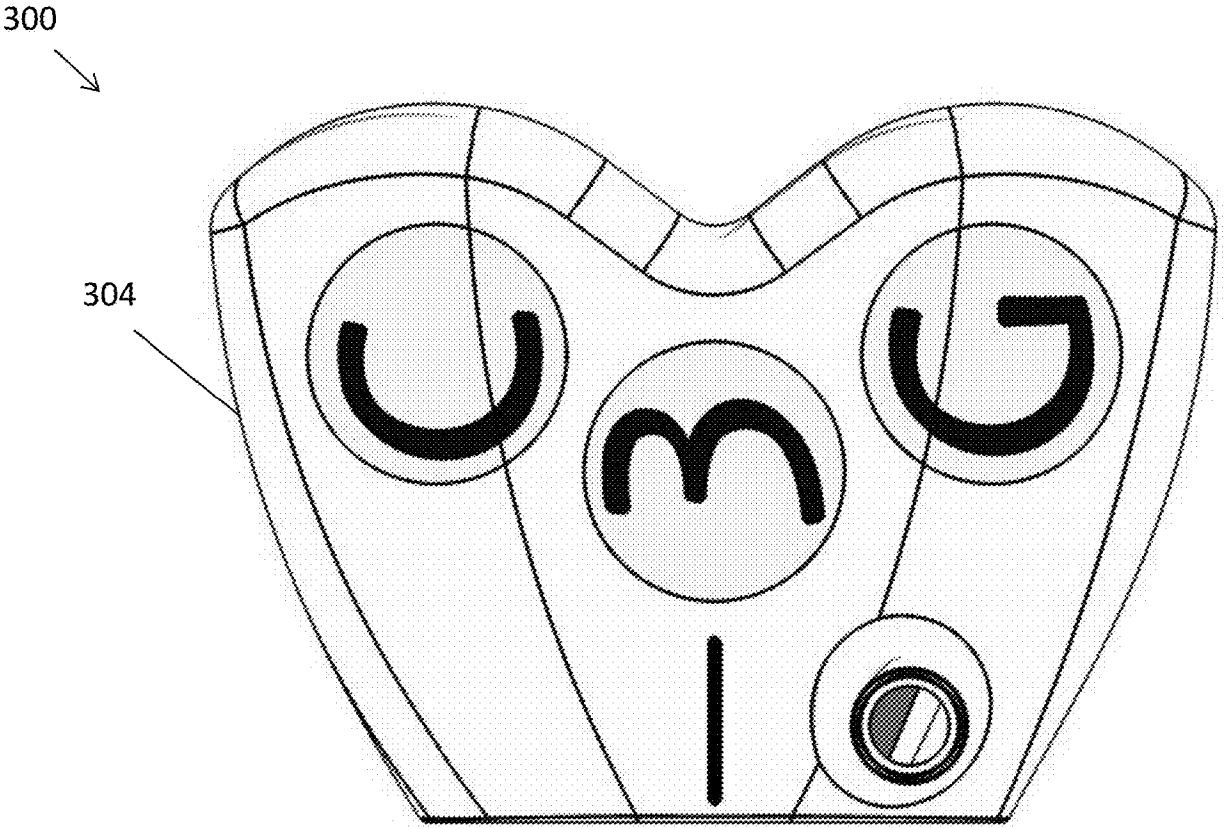
Figure 25:
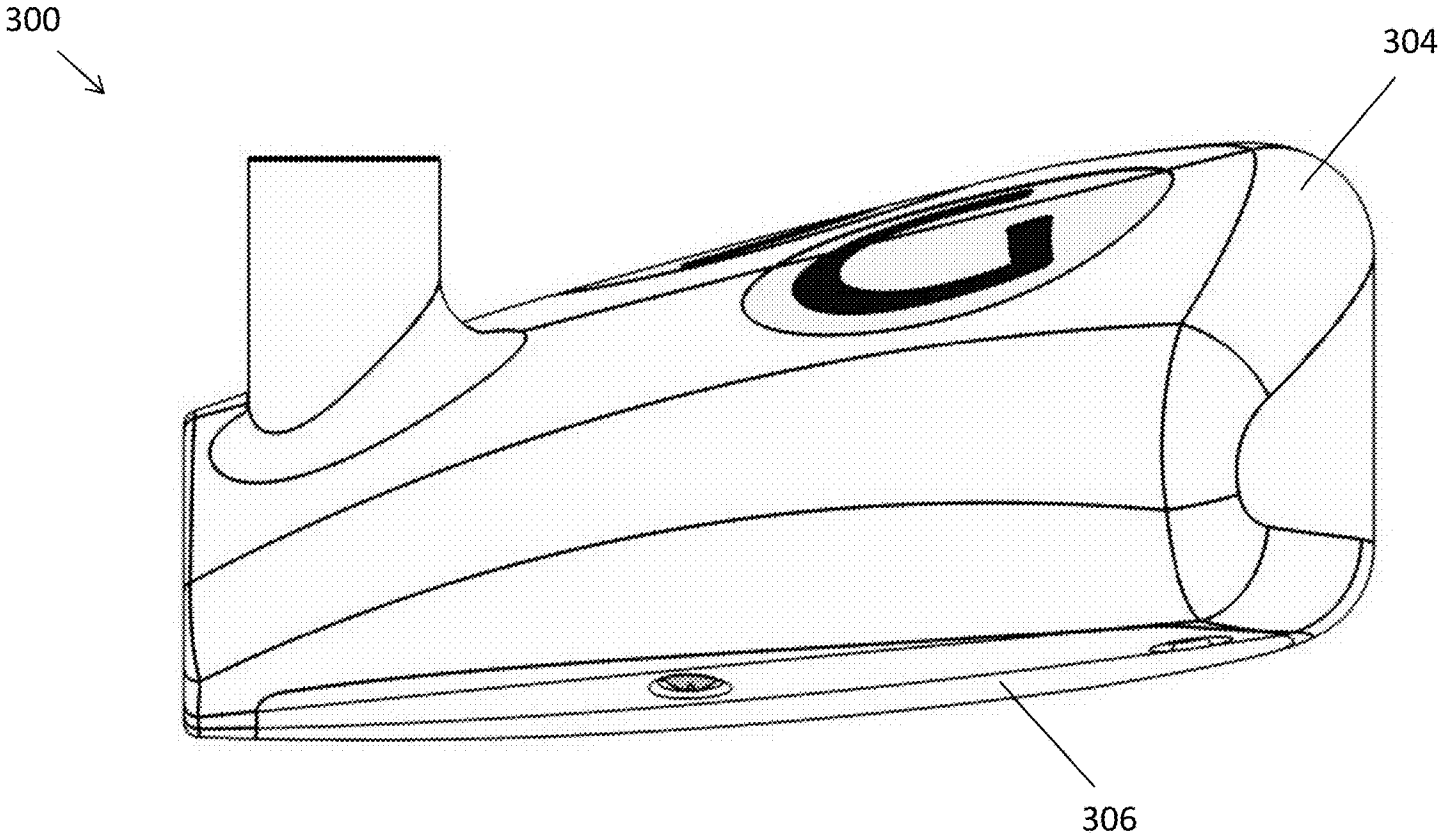
Figure 26:
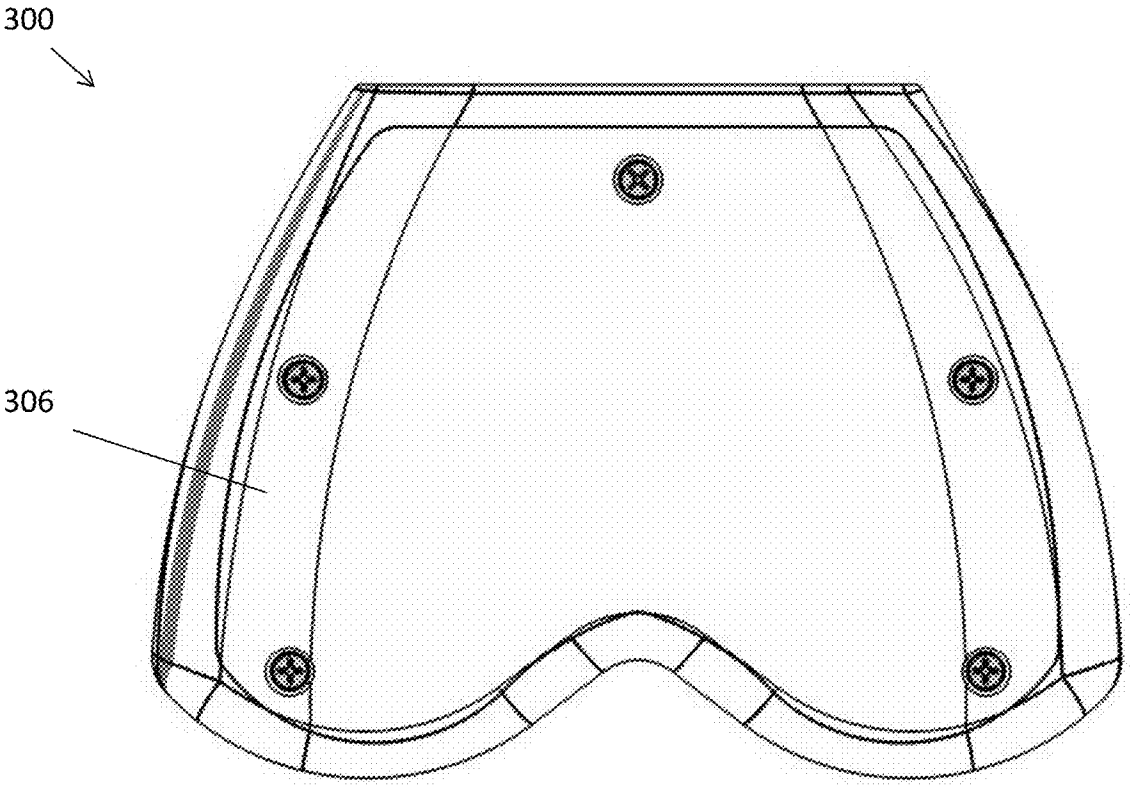
Figure 27:
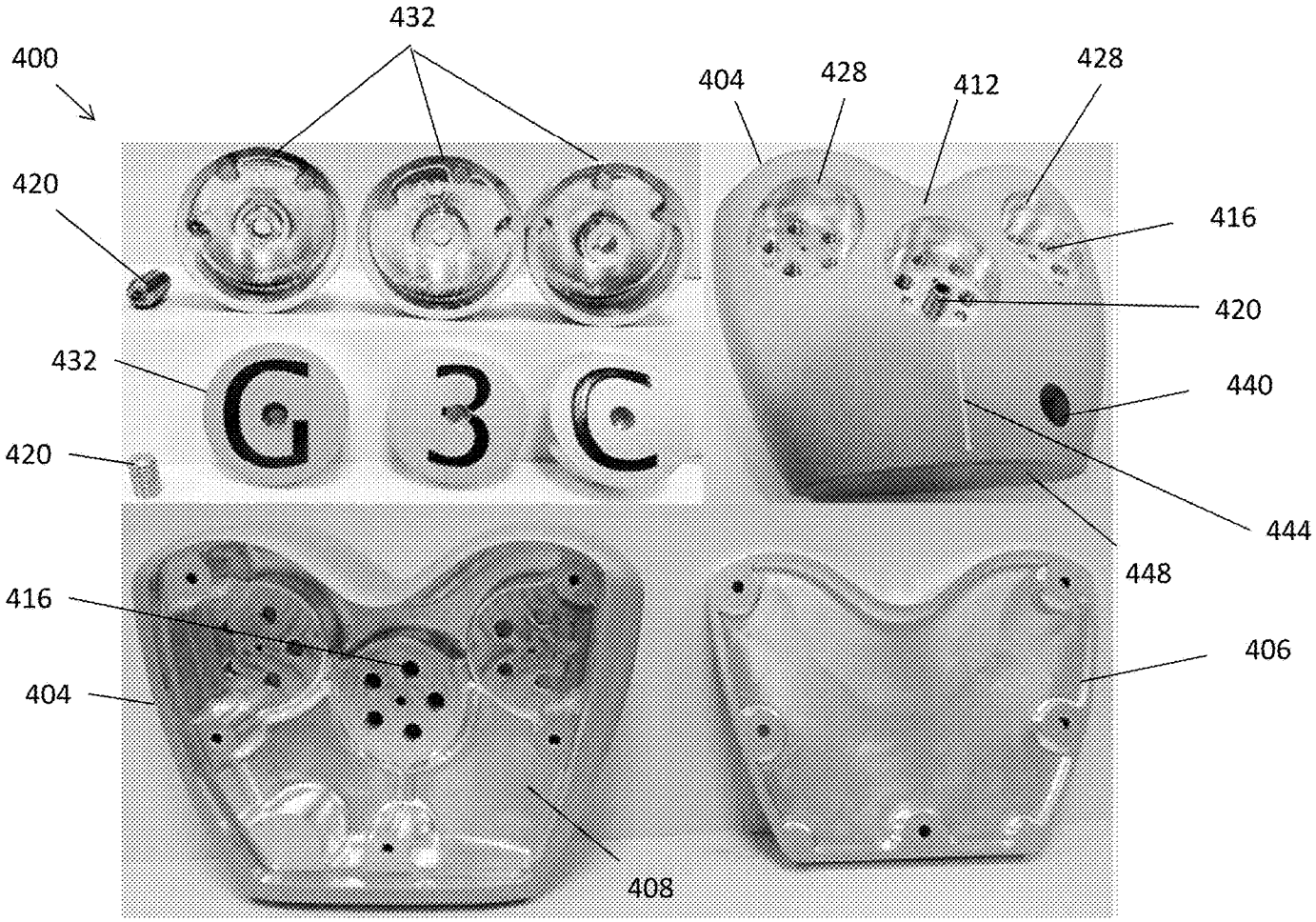
Figure 28:
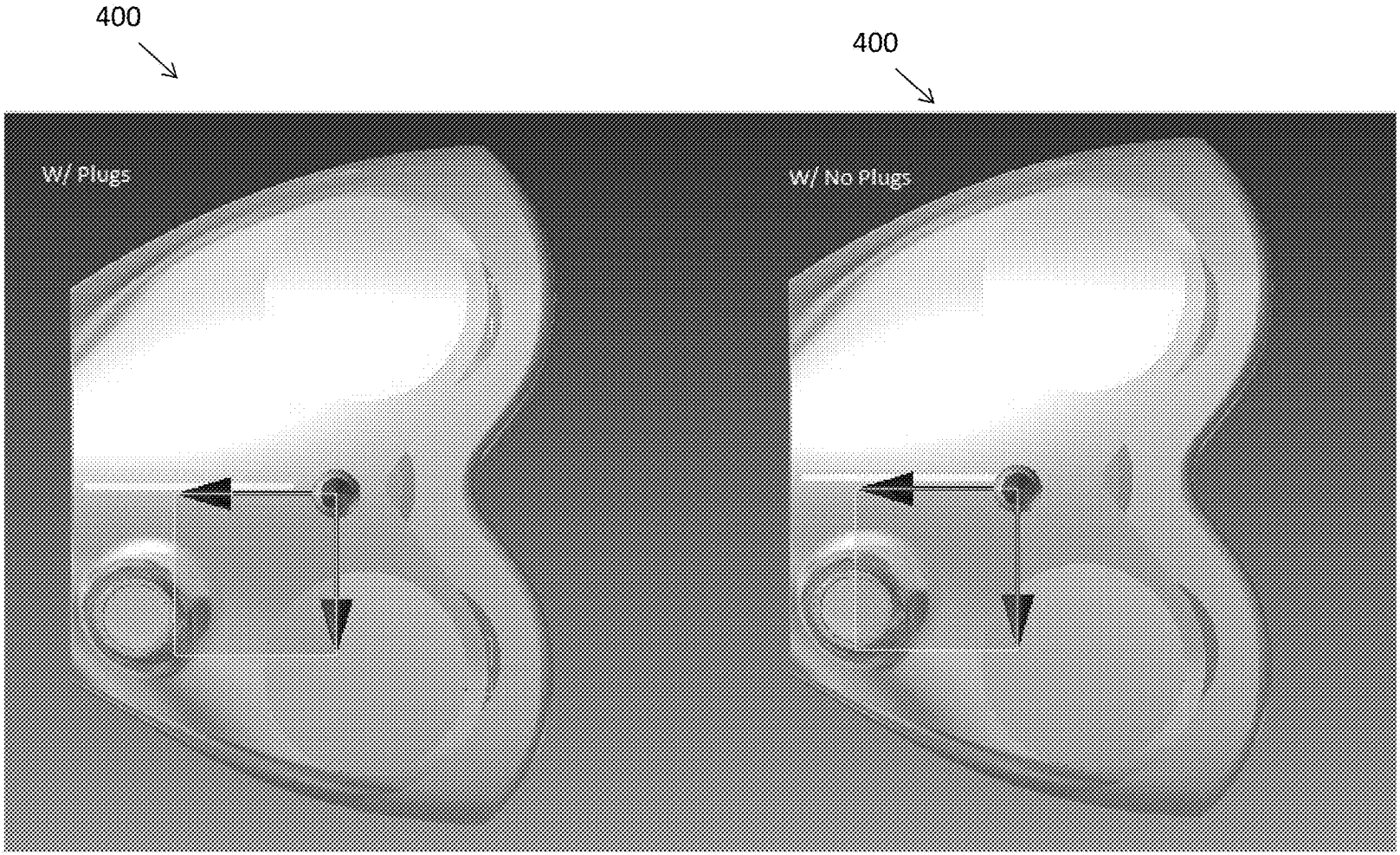
Figure 29:
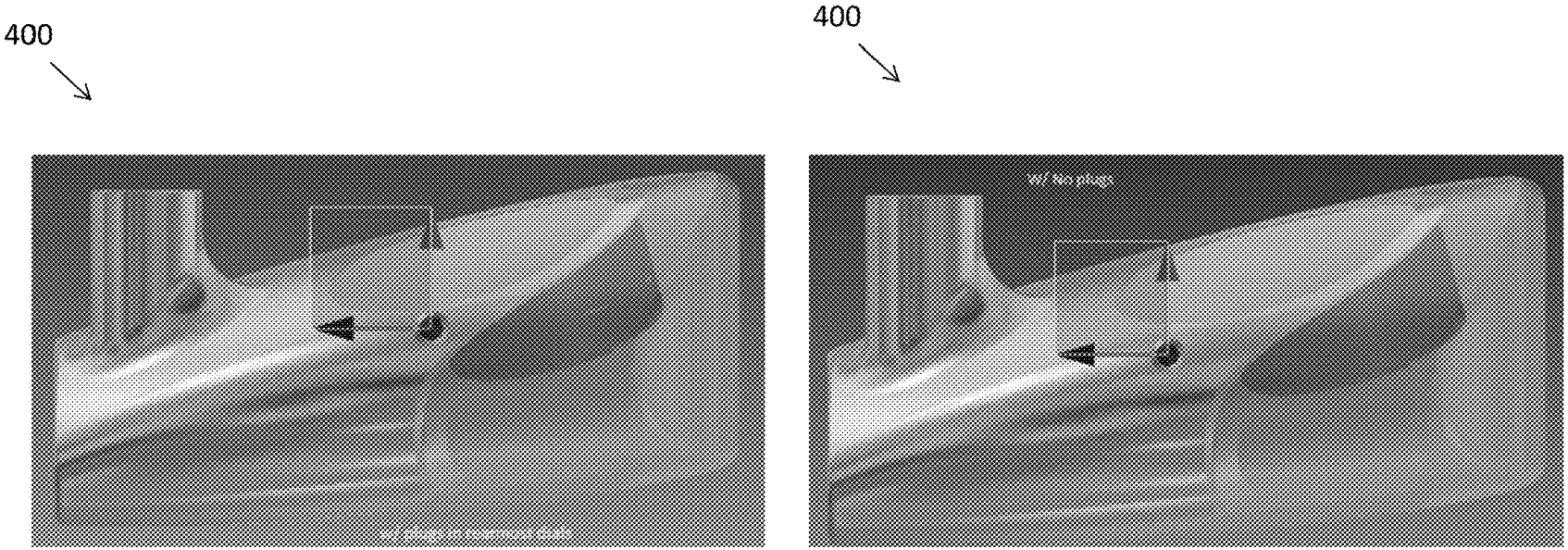

FIGS. 20 and 21 after the center of gravity adjustment features have been added to the hollow interior of the golf putter head and showing the exemplary manner by which the bottom portion of the golf putter head may be removably attached to the upper portion by mechanical fasteners;

FIG. 23 is a front view of the golf putter head shown in FIG. 18;

FIG. 24 is a top view of the golf putter head shown in FIG. 18;

FIG. 25 is a side view of the golf putter head shown in FIG. 18;

FIG. 26 is a bottom view of the golf putter head shown in FIG. 18;

FIG. 27 shows a golf putter head having a customizable center of gravity that is adjustable in three dimensions according to a fourth exemplary embodiment, where the golf putter head is shown unassembled; and FIGS. 28 and 29 shows the golf putter head shown in FIG. 27 after being assembled with weight plugs in the rearmost pockets or openings and without any weight plugs for comparison purposes to show the adjustment to the center of gravity location caused by the addition of the weight plugs.

Corresponding reference numerals indicate corresponding parts throughout the several views of the drawings.

DETAILED DESCRIPTION

Example embodiments will now be described more fully with reference to the accompanying drawings.

Disclosed herein are exemplary embodiments of golf putter heads having customizable centers of gravity adjustable in three dimensions. In exemplary embodiments, a relatively large thin-walled hollow golf putter head is configured to utilize or rely upon spring force to putt versus mass impact. The center of gravity of the thin-walled hollow golf putter head is adjustable by adding or introducing varying weights to, along, or adjacent a top surface of the hollow golf putter head. The golf putter head has a center of gravity higher than the center of gravity of a golf ball such that a very high percentage (e.g., about 75% with all weight plugs installed, etc.) of the overall weight of the golf putter head is above the golf ball's center of gravity. With these attributes, the golf putter head will cause the golf ball to begin rolling much sooner than conventional golf putter heads in the industry, e.g., almost a 300% improvement in time for ball rolling to occur versus skipping as compared to another conventional putter design, etc.

In an exemplary embodiment, the golf putter head has a single piece main body. The bottom of the golf putter head may be integrally attached or be an integral part of the main body. Alternatively, the bottom portion (e.g., bottom plate, etc.) of the golf putter head may be removably attached (e.g., via screws, other mechanical fasteners, etc.) in other exemplary embodiments.

The main body is hollow and defines an interior cavity. The main body includes a top surface having openings therein that extend from the top surface into the interior cavity. A variety of weight plugs, inserts, or pins (broadly, weights) may be inserted into the openings in the top surface at various positions and in various combinations to influence and thereby adjust and customize the overall center of gravity of the golf putter head in all 3 X-Y-Z dimensions. An array of weight plugs, inserts, or pins may be provided in different lengths, which changes their weight and influence on the golf putter head's center of gravity.

The openings may be disposed within one or more recessed portions. For example, the top surface may include three recessed portions respectively located adjacent or along the golf putter head's heel portion, middle or centerline portion, and toe portion. Each recessed portion may include five openings equally and circumferentially spaced apart from each other within the recessed portion. Caps may be positioned over the recessed portions to thereby cover the weight plugs, inserts, or pins within the openings of the recessed portions. The caps may be coupled (e.g., mechanically fastened, etc.) to the top surface.

In another exemplary embodiment, a bracket is attached to or along an inside surface of a hollow golf putter head. For example, a thin-walled bracket may be attached (e.g., welded, glued, etc.) internally along or to the inner surface of the portion of the golf putter head that also defines the putter's front impact or striking surface. The portion of the bracket that is attachable to the inside surface of the hollow golf putter head may have a shape and size corresponding or complementary to the shape and size of the putter's front impact or striking surface. The bracket includes one or more elongate members that extend outwardly from the bracket portion attachable to the inside surface of the hollow golf putter head. One or more support members having openings are slidable along and rotatable relative to the elongate members. To adjust and customize the overall center of gravity of the golf putter head in all 3 X-Y-Z dimensions, a variety of weight plugs or inserts (broadly, weights) may be inserted into the openings in the support members at various positions and in various combinations, and the support members may be slid and rotated relative to elongate members. The bottom portion of the golf putter head is removable and reattachable (e.g., mechanically fastened, etc.) to allow access into the hollow interior of the golf putter head for adding and removing weight plugs and positioning and repositioning the support members along the elongate members.

The one or more elongate members may include two slotted fingers each having a slot extending (e.g., linearly, etc.) along a portion of the length thereof. The two slotted fingers may extend outwardly (e.g., linearly, etc.) from the bracket portion such that there is an acute angle between the two slotted fingers (e.g., about 30 degrees, etc.). The support members may include two circular disks or dials that are respectively coupled (e.g., mechanically fastened, etc.) to the corresponding slotted fingers. Each dial may include five pockets (broadly, openings) equally and circumferentially spaced apart from each other along the dial. To adjust the overall center of gravity of the golf putter head, weight plugs or inserts may be inserted into the pockets at various depths, and each dial may be slid along and rotated relative to the slot of the corresponding slotted finger before the dial is fixed or held in place. The dials may be loosened to allow the dials to be slidably moved up and down the slotted fingers to a chosen position and then tightened and locked into position, to thereby readjust the overall center of gravity of the golf putter head.

In another exemplary embodiment, inserts (e.g., threaded "T" inserts, etc.) are attached (e.g., welded, glued, etc.) at a variety of locations along the inside top surface of the hollow golf putter head. An array or series of threaded weights (e.g., threaded hex screws, etc.) of varying length and weight are provided. The golfer may add one or more threaded weights to one or more of the inserts at various locations and in various combinations to adjust the overall center of gravity of the golf putter head. For example, the golfer may add a threaded weight to all or less than all of the inserts along the inside top surface of the golf putter head.

In exemplary embodiments, a golfer is presented with an array of weight plugs or inserts (broadly, weights) that can be added to a relatively large hollow golf putter head at the golfer's discretion to achieve a preferred overall weight. Because the golf putter head is hollow and the weight plugs are added to or adjacent the top surface of the golf putter head, an inordinate percentage of the weight is higher than the golf ball's centerline.

In an exemplary embodiment, weights may be added to three working areas located under three recessed portions or cavities along or on the top surface. The weights have varying lengths and can be placed more towards the golf putter head's heel or toe or more forward or back. With the variety of potential weight placements, the golfer is able to influence the golf putter head's center of gravity in all 3 dimensions. The golf putter head is also hollow and configured to use spring force when putting versus "mass" impact. The golf putter head may be made of titanium and conform to the Coefficient of Restitution (COR) restrictions of the USGA. Because spring force is used to drive the ball during putting, the putting stroke is dramatically shorter, which means less opportunity for the golfer to inject negatives into the intended putting path.

In exemplary embodiments, the golf putter head may comprise a very large hollow head that is as large as current legal metal drivers. The golf putter head may be relatively light weight with thin walls. The golf putter head may be made of a variety of materials including metals (e.g., titanium, etc.), plastic, etc.

In an exemplary embodiment, the golf putter head includes two portions or halves. The first or front portion includes the striking surface, the bottom, and sides, and the top surface where the shaft is attached. The top surface may be of a geometric shape curving upwards from the striking surface, possibly parabolic. The second or back portion of the golf putter head is detachable (e.g., using one screw, etc.). The golf putter head may be used while warming up without having the back or rear portion attached. With the back or rear portion removed, the golfer is allowed access into the hollow interior of the golf putter head for adding weights to appendages adjacent the heel and toe positions. With the rear or back portion removed, the golfer can still practice putting and then make internal weight adjustments. Once satisfied, the golfer may then attach the rear or back portion, e.g., using a basic Phillips head screwdriver, etc.

Because the golf putter head is larger than conventional golf putter heads, this exemplary embodiment provides the golfer with more effective heel and toe counterbalancing. Furthermore, the appendages are configured for movement or have the means of pivoting in three dimensions independently. This allows the golfer discretionary influence over the location of the center of gravity of the overall golfer putter head. This allows the golfer to locate the center of gravity so as to virtually "dial out" the golfer's natural tendency to hook or slice the ball during the putting stroke.

In another exemplary embodiment, the golf putter head may be a single piece that is hollow. In this exemplary embodiment, pockets are presented to the golfer along or on the top surface of the thin-walled hollow golf putter head. The pockets are deep enough to hold varying stacks of (e.g., one, two, more than two, etc.) of weight plugs. The golf putter head is configured such that the golfer can not only decide how many weight plugs to utilize in order to result in a desired overall golf putter head weight, but the golfer also can decide into which pockets the weights are added, thus influencing the overall center of gravity in all 3 dimensions. For example, a pocket into which a single weight plug is inserted into the bottom of the pocket influences the center of gravity differently from a pocket into which two weight plugs are added or from a pocket into which a single plug added and is at the top of the pocket versus the bottom of the pocket. With the various pockets and weight plugs, a myriad of options exist that allow an optimum or at least improved golf putter head for a particular golfer on the exact daily conditions of the golf course the golfer intends to play.

In exemplary embodiments, the golfer will not only be able to adjust the golf putter head by weight and center of gravity to augment the personal aspects of the golfer's skills, but the golfer will also be able to adjust the golf putter head to the daily characteristics of the particular golf course conditions including, humidity, grass style, grass cut and type, dampness, etc.

In exemplary embodiments, an internal 3-D weighting mechanism may occupy most of the internal hollow space of the large thin-walled golf putter head. The 3-D weighting mechanism (e.g., bracket, etc.) may be intimately attached to the inside striking area of the golf putter head. In some exemplary embodiments, the 3-D weighting mechanism may also be configured to be operable or to act as the striking surface itself. The 3-D weighting mechanism and its appendages may be arranged so that when the golf putter head contacts the golf ball during the putting stroke, the mass of the added weights creates a torque action that is transmitted thru the mechanism into the putter's striking surface. This may advantageously imbue a "moment arm" (torque) onto the golf ball causing immediate rolling, thus ensuring a straighter putt.

In exemplary embodiments, the large hollow thin-walled golf putter head may have a striking surface with spring characteristics such that the golfer may use a dramatically reduced back stroke and stroke thru during the putt. By using shorter strokes, the golfer is much more able to stroke along the intended path. A dramatically reduced putting stroke also removes one of the degrees of freedom that can adversely affect a golfer's stroke. A much shorter stroke allows the golfer to putt with very little movement while avoiding pivoting of the golfer's body and detracting from a straight putting stroke.

In exemplary embodiments, the golf putter head has a larger volume in 3 dimensions thus providing more "floor space" in which to provide visual alignment aids to the golfer. The large volume thin-walled hollow golf putter head may have a center of gravity higher than the golf ball's center of gravity without any added weights. But having the means of adding weights into the top putter head surface or onto an adjustable mechanism located along the inside upper section of the golf putter head results in a putter that has a vast majority (e.g., about 75% with all weight plugs installed, etc.) of its overall weight situated higher than the golf ball center of gravity. This all provides a better performing golf putter head.

With reference now to the figures, FIGS. 1 through 8 illustrate a first exemplary embodiment of a golf putter head 100 embodying one or more aspects of the present disclosure. As shown, the golf putter head 100 has a single piece main body 104 that is hollow and defines an interior cavity 108.

The main body 104 includes a top surface 112 having holes 116 (broadly, openings) therein that extend from the top surface 112 into the interior cavity 108. A variety of weight plugs, inserts, or pins 120 (broadly, weights) may be inserted into the holes 116 in the top surface 112 at various positions and in various combinations to influence and thereby adjust and customize the overall center of gravity of the golf putter head 100 in all 3 X-Y-Z dimensions. An array of weight plugs 120 may be provided in different lengths, which changes their weight and influence on the golf putter head's center of gravity. In this exemplary embodiment, the weight plugs 120 are inserted into and held in place by weight holders 124 (e.g., sleeves, keyed ejector pins, etc.), which, in turn, are removably positionable in the holes 112. Depending on the golfer's preferences, one or more weight plugs 120 may be inserted into any one or more of the weight holders 124 to thereby adjust and customize the center of gravity of the golf putter head 100 in three dimensions.

Figure 1:
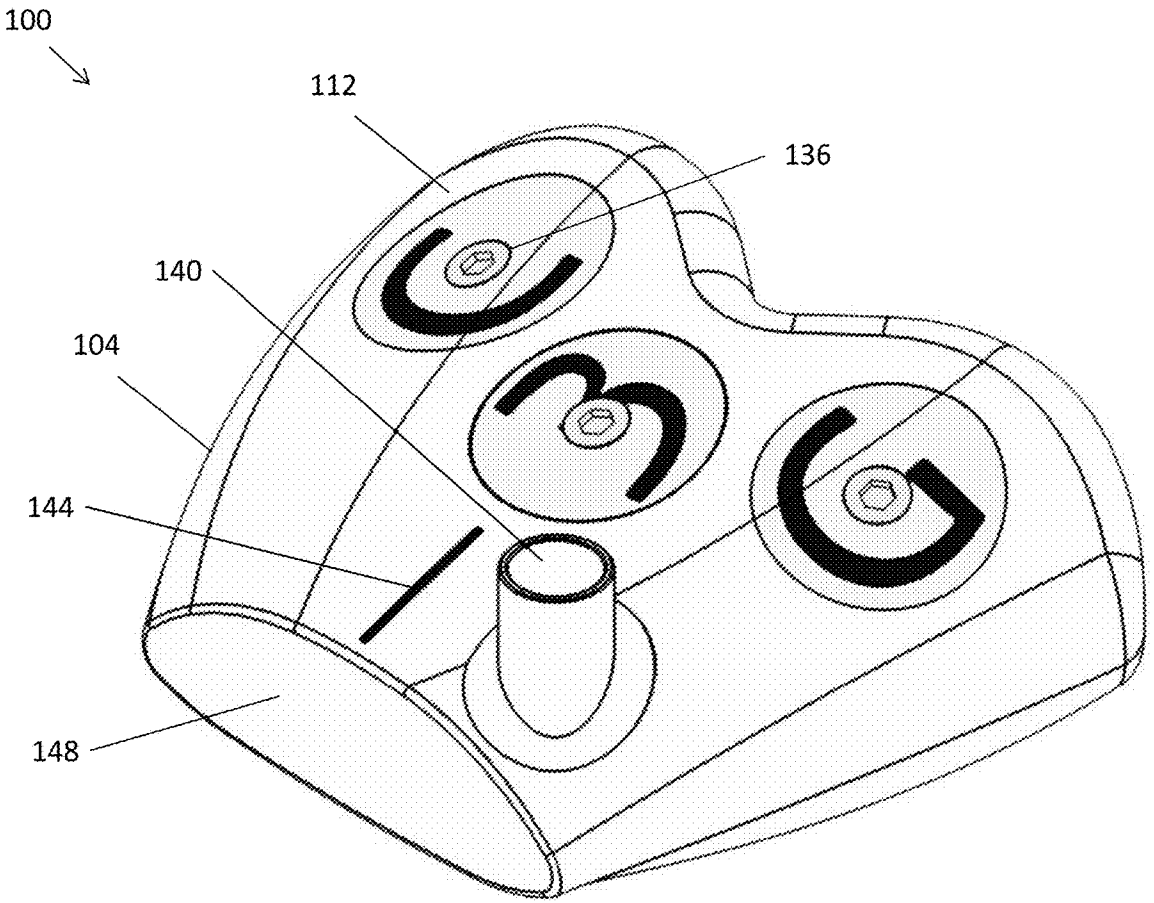
FIG. 1 is a perspective view of a golf putter head having a customizable center of gravity that is adjustable in three dimensions according to a first exemplary embodiment.
Figure 2:
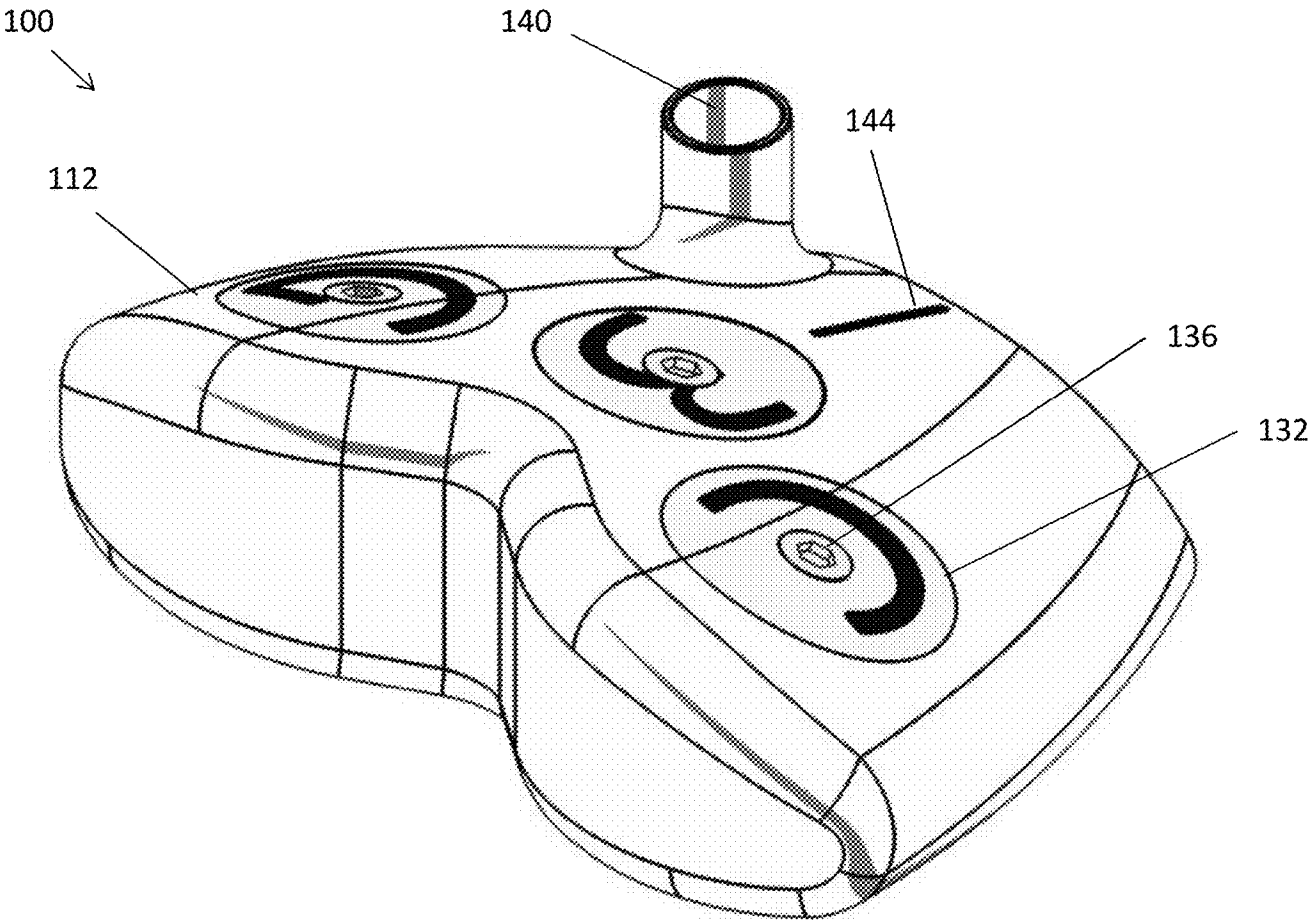
FIG. 2 is a back perspective view of the golf putter head shown in FIG. 1.
Figure 3:
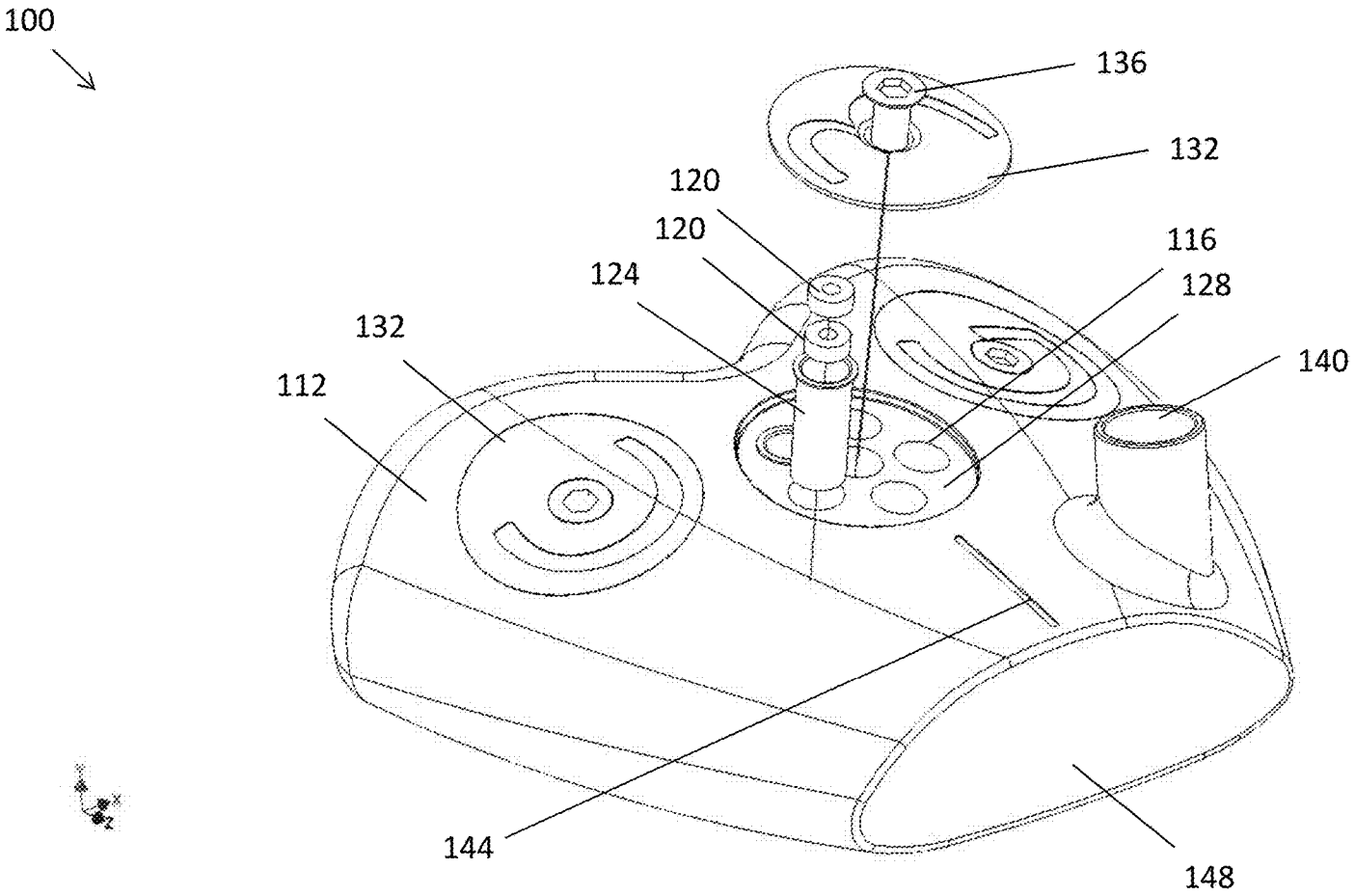
FIG. 3 is an exploded perspective view of the golf putter head shown in FIG. 1, and showing features that allow adjustment to the center of gravity of the golf putter head aligned for positioning within openings into a hollow interior or cavity of the golf putter head.
Figure 4:
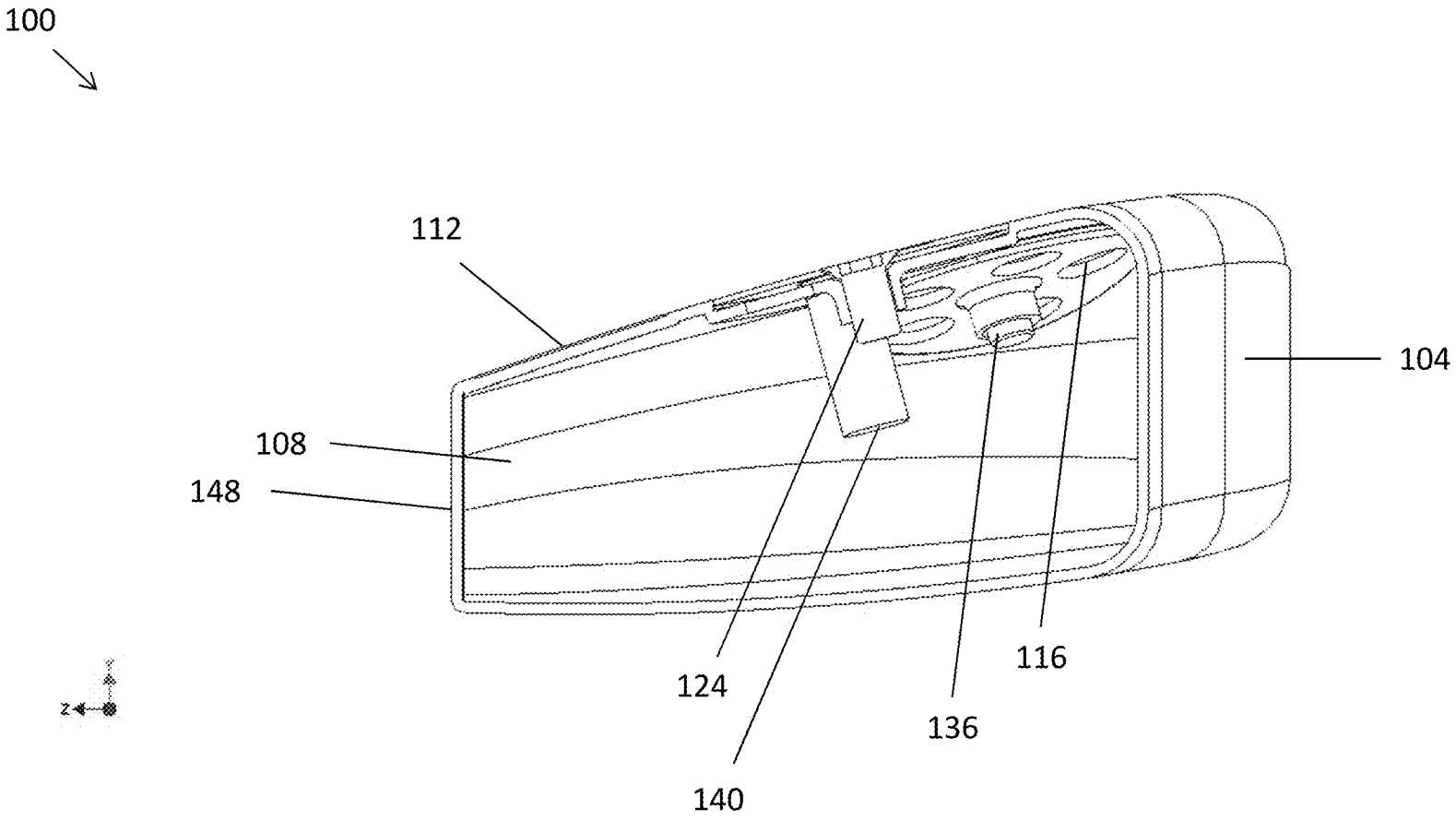
FIG. 4 is a cross-sectional side view of the golf putter head shown in FIG. 1.
Figure 5:
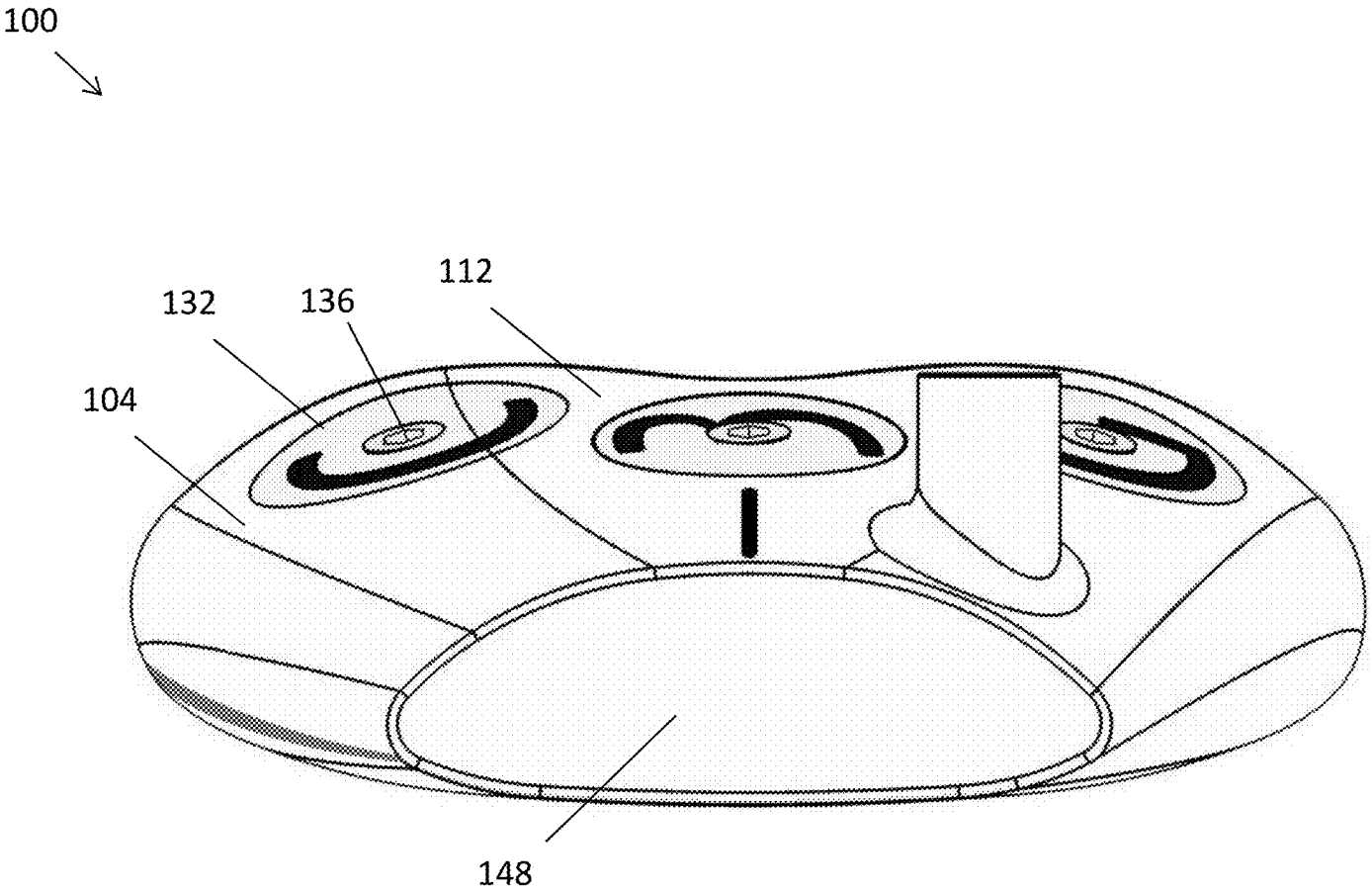
FIG. 5 is a front view of the golf putter head shown in FIG. 1.
Figure 6:
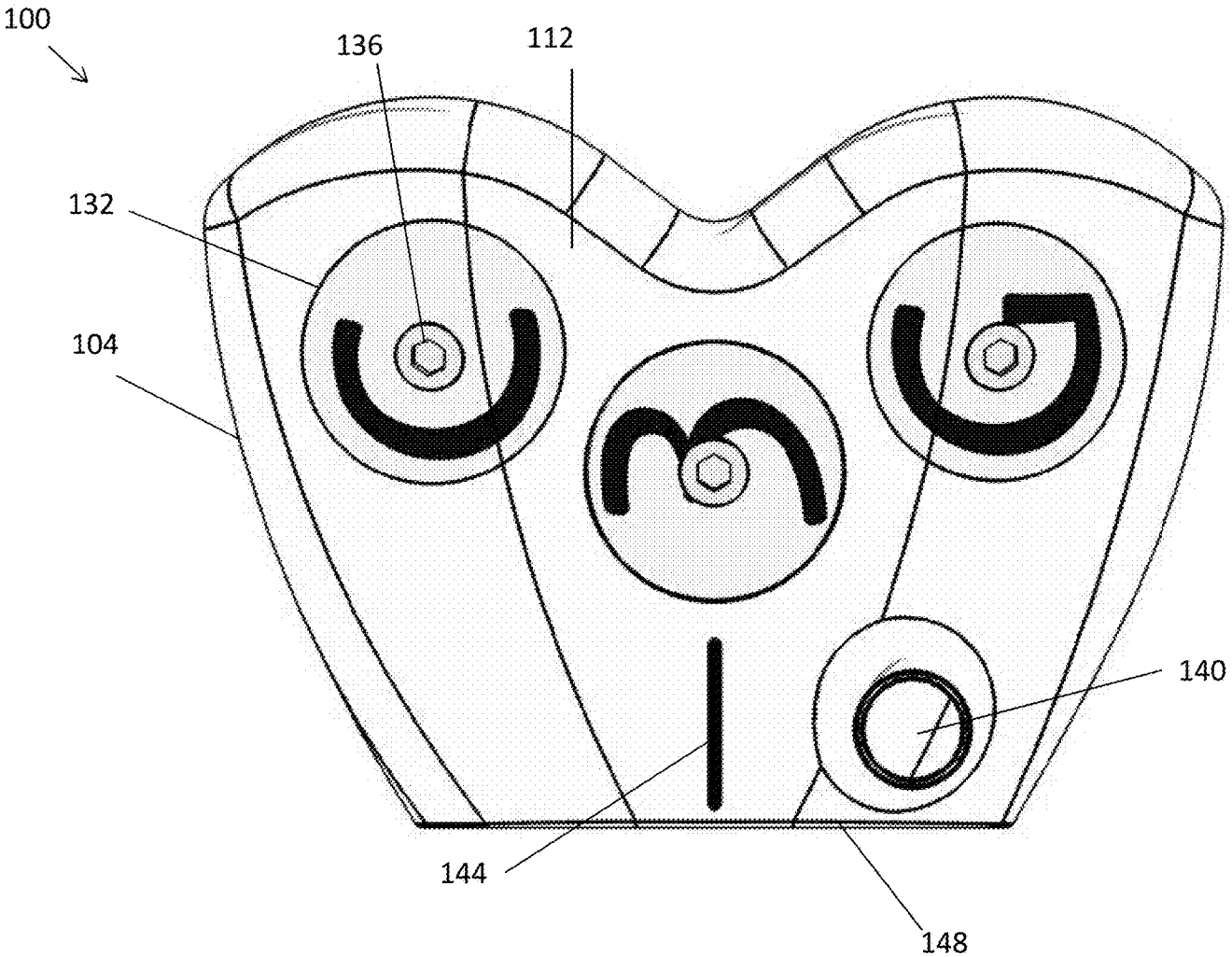
FIG. 6 is a top view of the golf putter head shown in FIG. 1.
Figure 7:
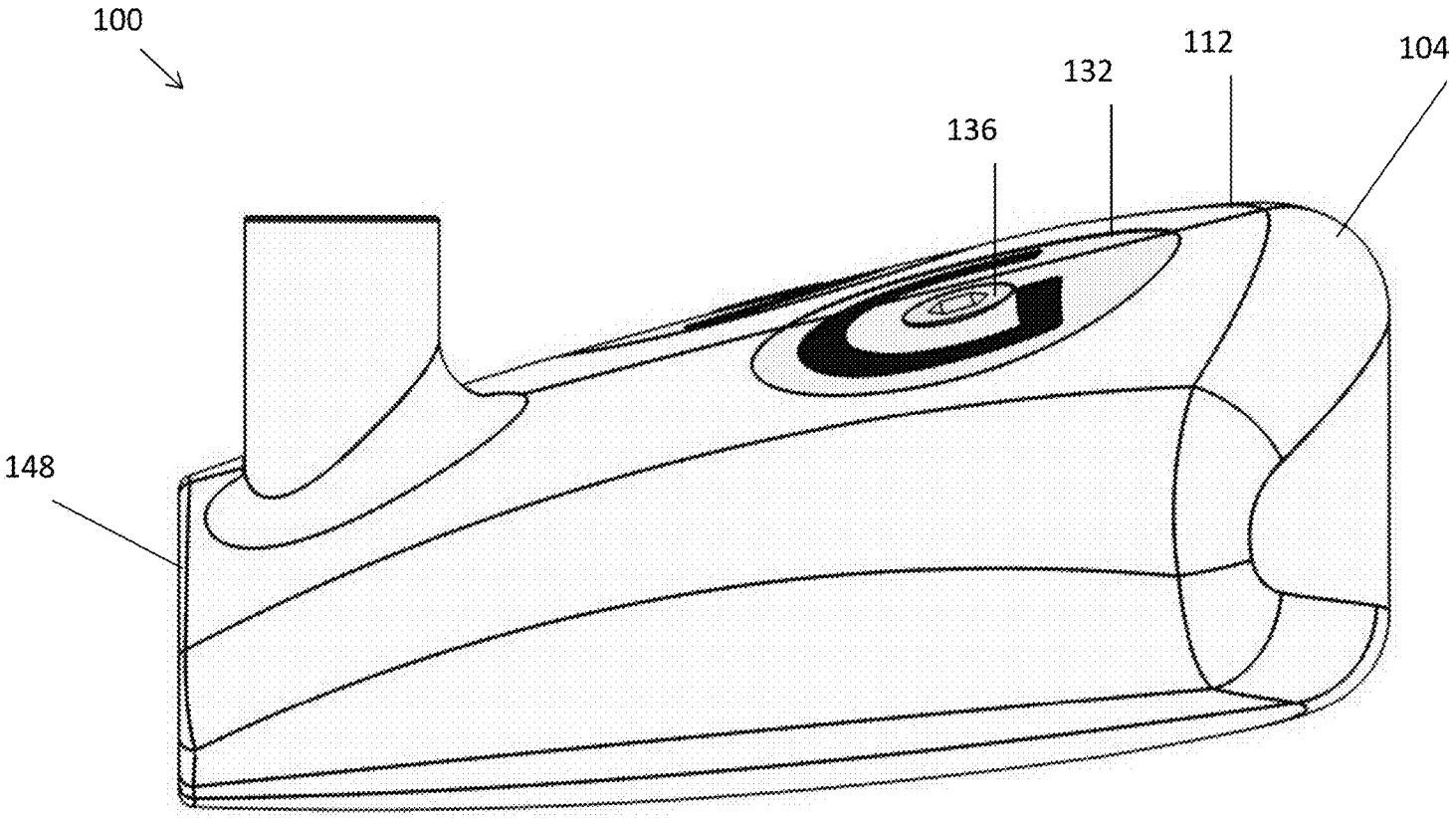
FIG. 7 is a side view of the golf putter head shown in FIG. 1.
Figure 8:
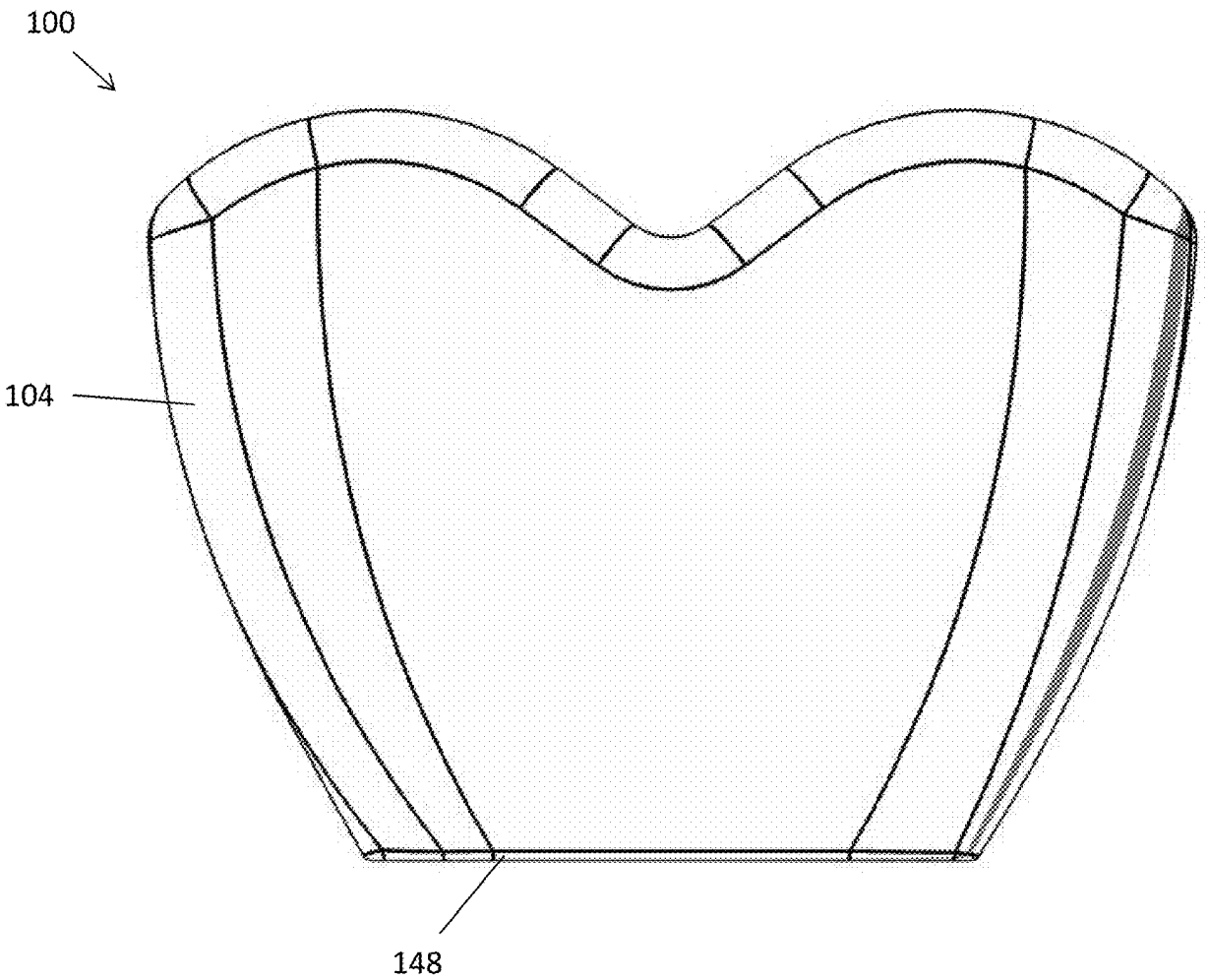
FIG. 8 is a bottom view of the golf putter head shown in FIG. 1.
Figure 9:
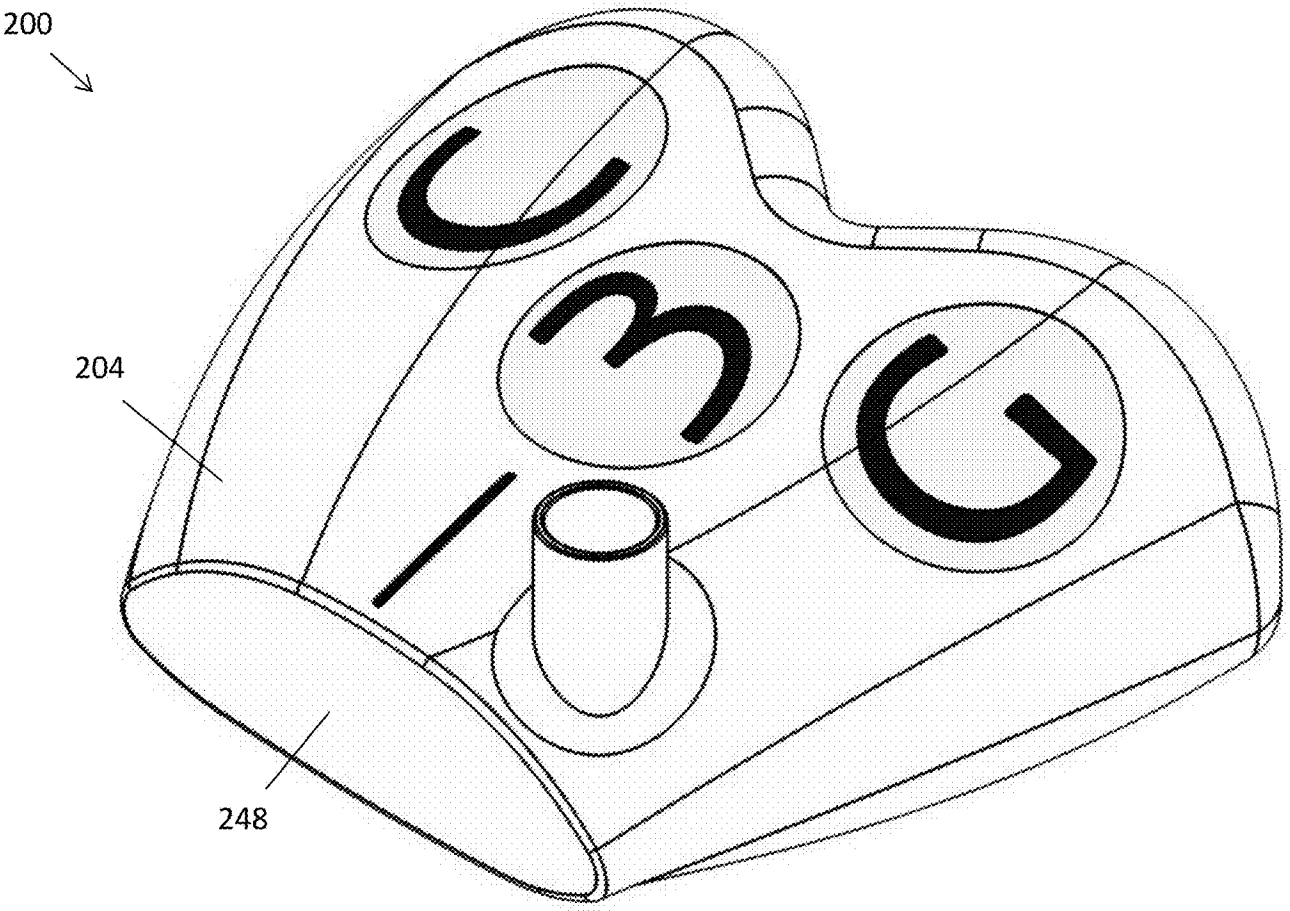
FIG. 9 is a perspective view of a golf putter head having a customizable center of gravity that is adjustable in three dimensions according to a second exemplary embodiment.
Figure 10:
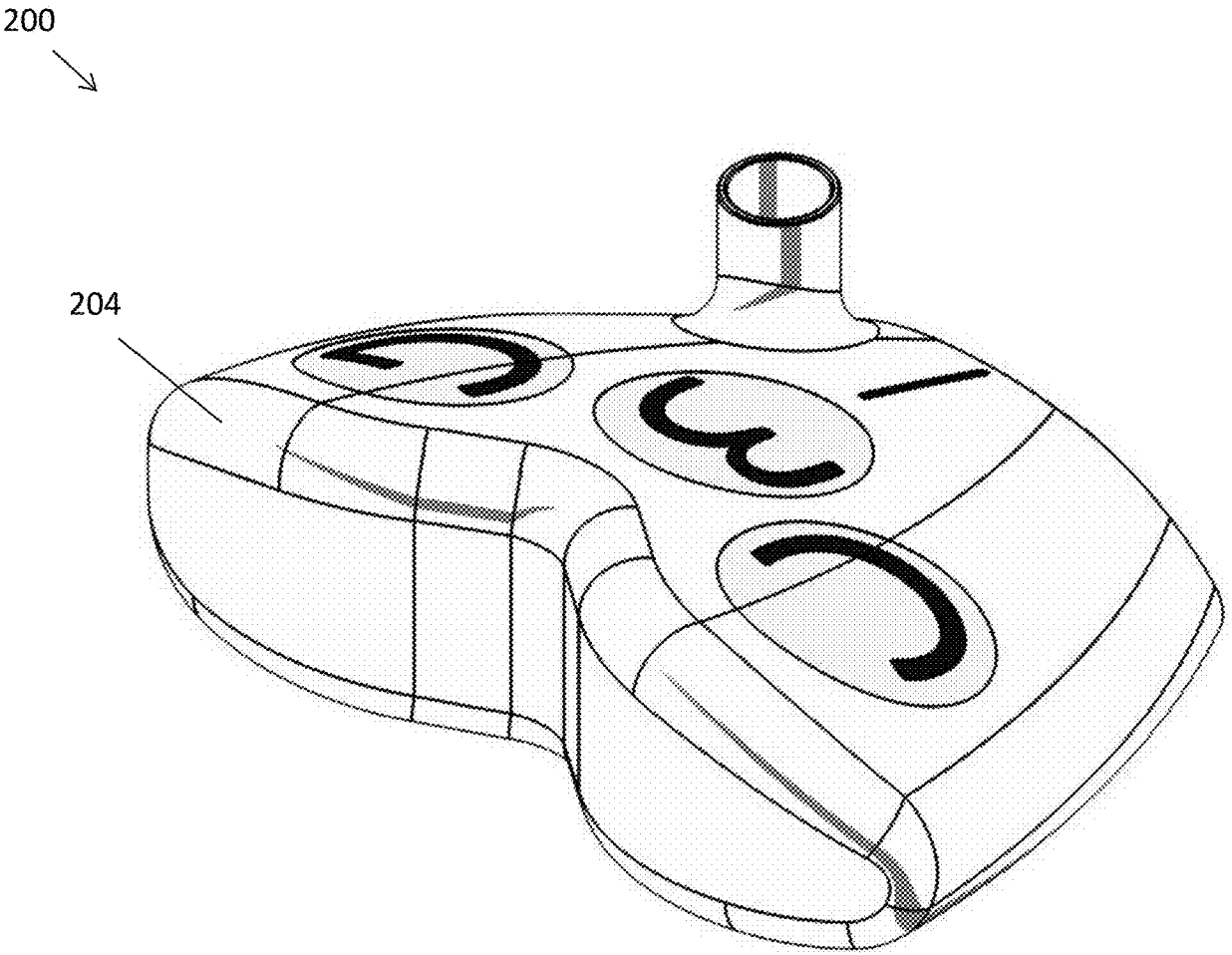
FIG. 10 is a back perspective view of the golf putter head shown in FIG. 9.

As shown in FIG. 3, the holes 116 are disposed within recessed portions 128 along the top surface 116. In this example, the golf putter head 100 includes three (or first, second, and third) recessed portions 128 respectively located adjacent or along the golf putter head's heel portion, middle or centerline portion, and toe portion. Each recessed portion 128 includes five holes 116 equally and circumferentially spaced apart from each other within the corresponding recessed portion 128. Accordingly, the golf putter head 100 includes fifteen different holes 116 each at one of at fifteen different locations. By way of example, the golfer may be provided with fifteen weight plugs 120 of the same or different weight in case the golfer wants to add a weight plug 120 to each hole. Or, for example, the golfer may be provided with two or more sets of fifteen weight plugs 120 in different weights.

First, second, and third caps 132 may be respectively positioned over the first, second, and third recessed portions 128 to thereby cover the weight plugs 120, weight holders 124, and any unused holes 116. The caps 132 may be coupled to the top surface 116, e.g., using mechanical fasteners 136, etc.

The golf putter head 100 also includes a shaft hole 140 and a guide line 144. The guide line 144 is aligned with a center of the striking surface 148. The guide line 144 is also generally perpendicular to the striking surface 148. The guide line 144 provides a visual alignment aid to the golfer.

In some exemplary embodiments, the holes 116 may be internally threaded. The outer surface of the weight plugs 120 may be threaded. The threaded weight plugs 120 may include a hexagonal opening or socket such that a hex key or Allen wrench may be used for rotating and threadedly engaging the threaded weight plugs 220 into the threaded holes 116. The threaded weight plugs 120 may be provided in different weights, or they may each have the same weight.

FIGS. 9 through 17 illustrate a second exemplary embodiment of a golf putter head 200 embodying one or more aspects of the present disclosure. The golf putter head 200 includes a hollow body portion 204 defining an interior cavity 208 (FIG. 11) and a removable bottom portion 206. The bottom portion 206 is removably attachable to the body portion 204, e.g., via mechanical fasteners 210 (FIG. 13), etc.

Figure 11:
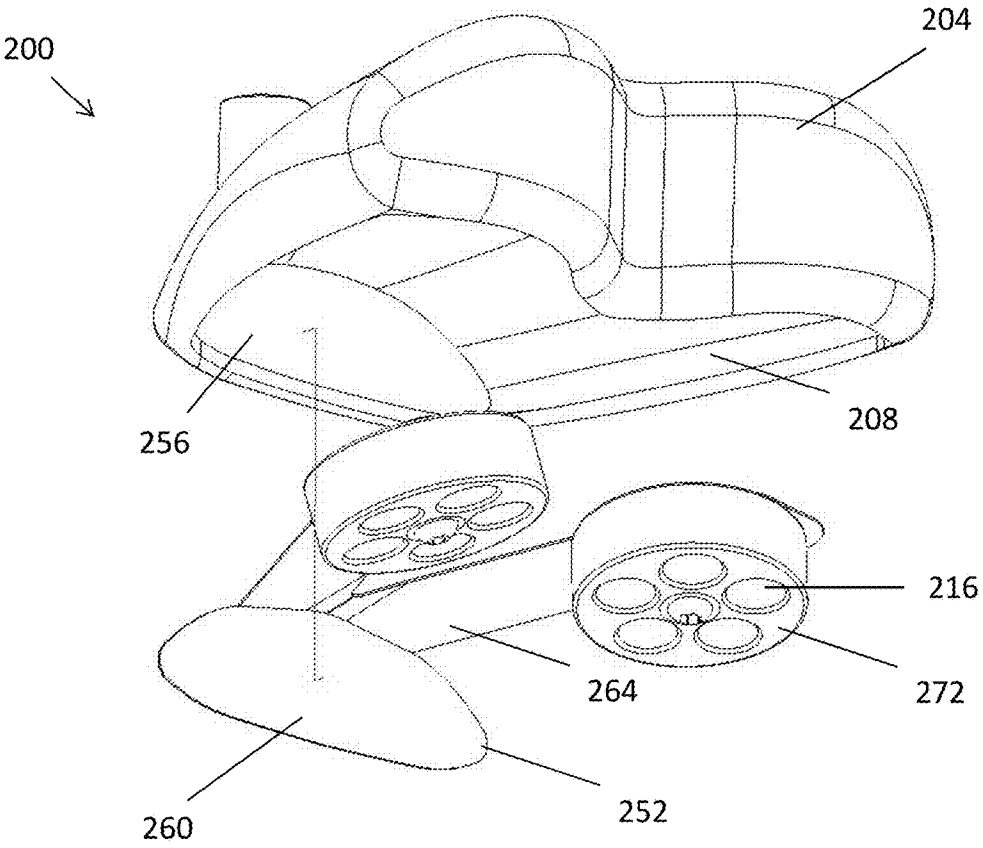
FIG. 11 is an exploded perspective view of the golf putter head shown in FIG. 9, and showing features that allow adjustment to the center of gravity of the golf putter head aligned for positioning within a hollow interior or cavity of the golf putter head.
Figure 12:
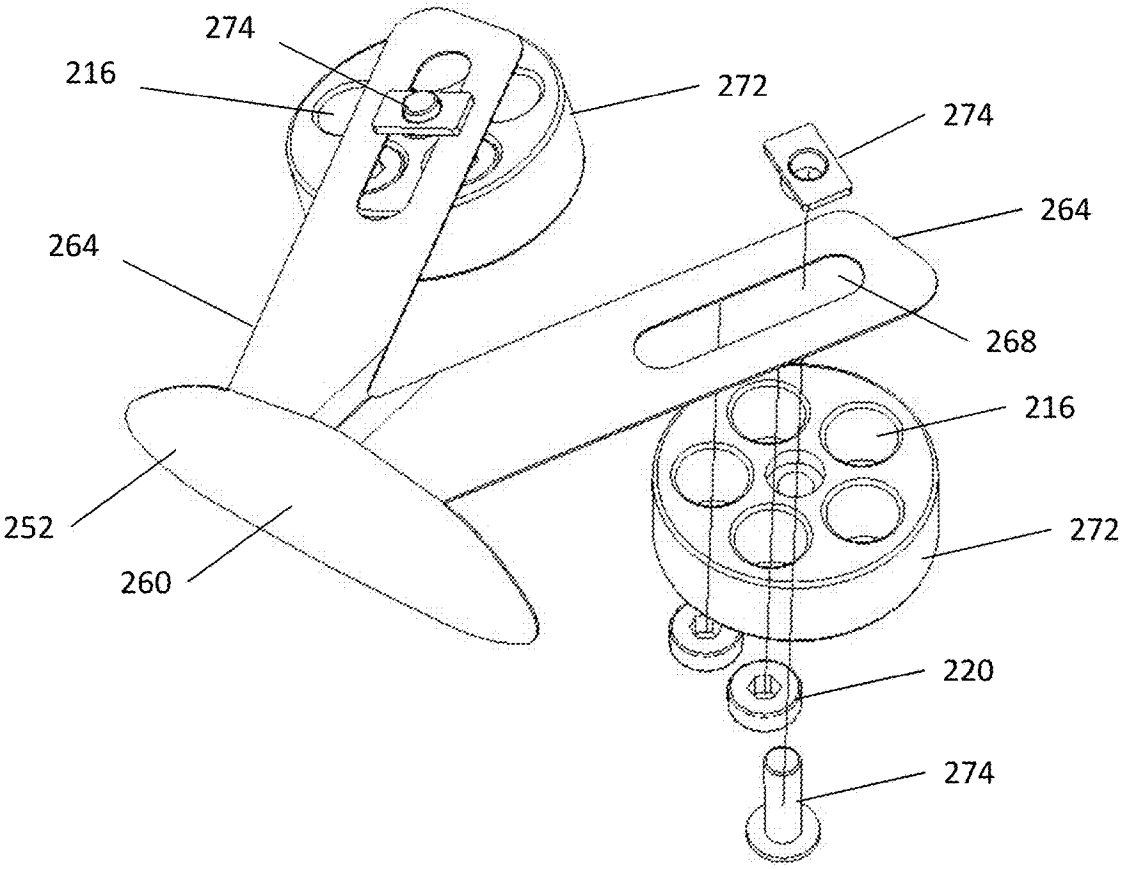
FIG. 12 is a perspective view showing the features that allow adjustment to the center of gravity of the golf putter head shown in FIG. 11.
Figure 13:
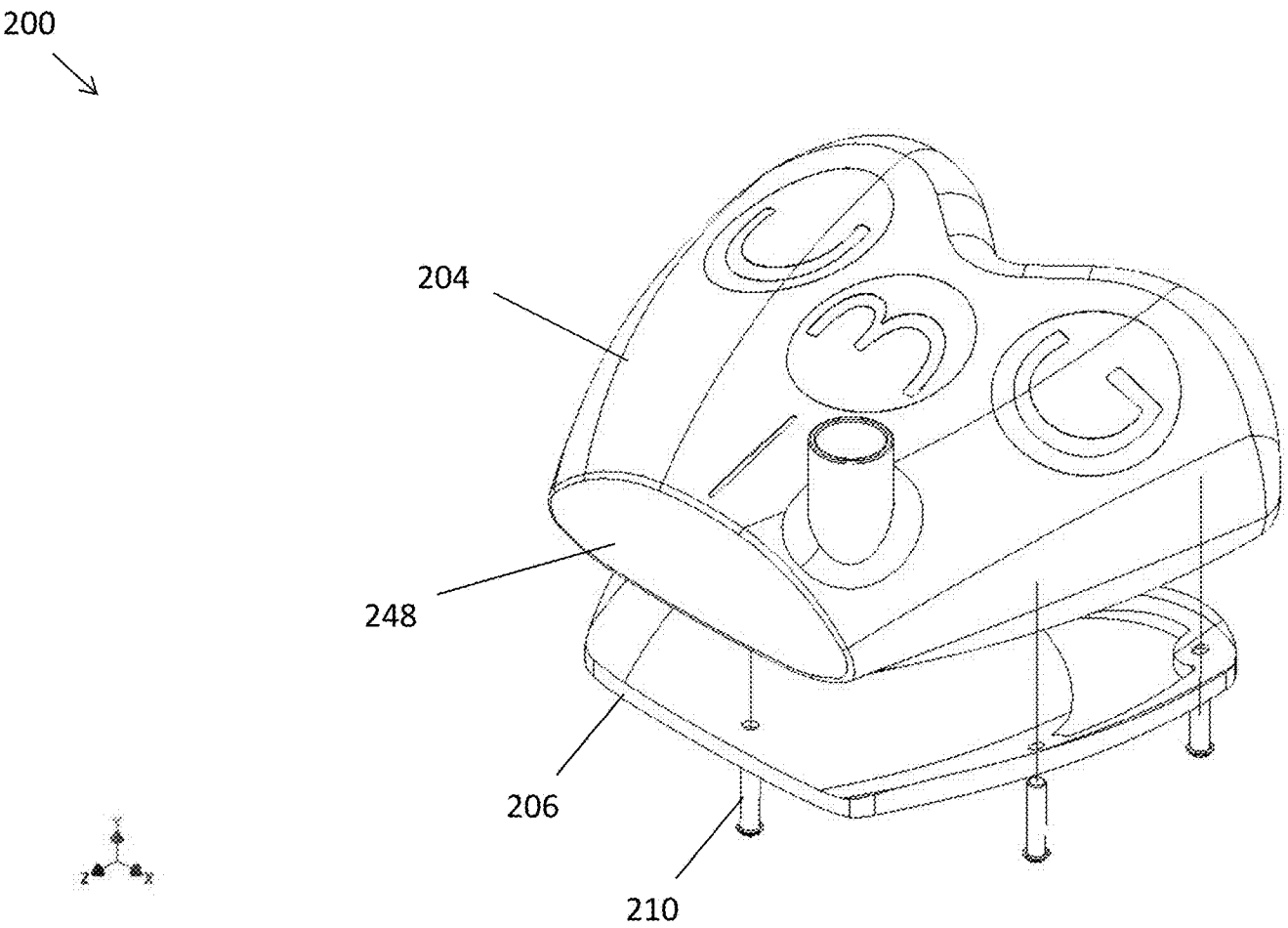
FIG. 13 is an exploded perspective view of the golf putter head shown in FIG. 11 after the center of gravity adjustment features have been added to the hollow interior of the golf putter head and showing the exemplary manner by which the bottom portion of the golf putter head may be removably attached to the upper portion by mechanical fasteners.
Figure 14:
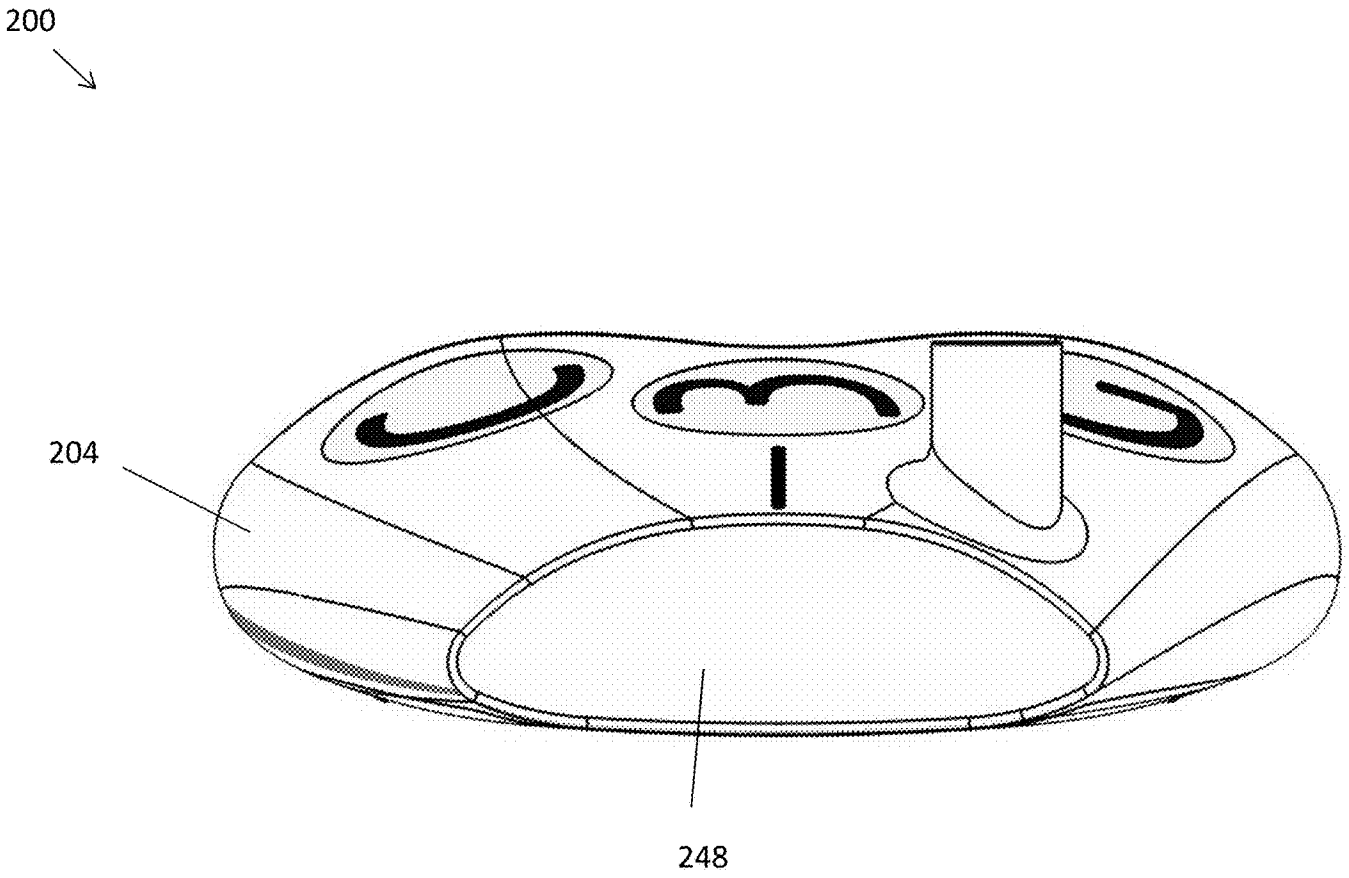
FIG. 14 is a front view of the golf putter head shown in FIG. 9.
Figure 15:
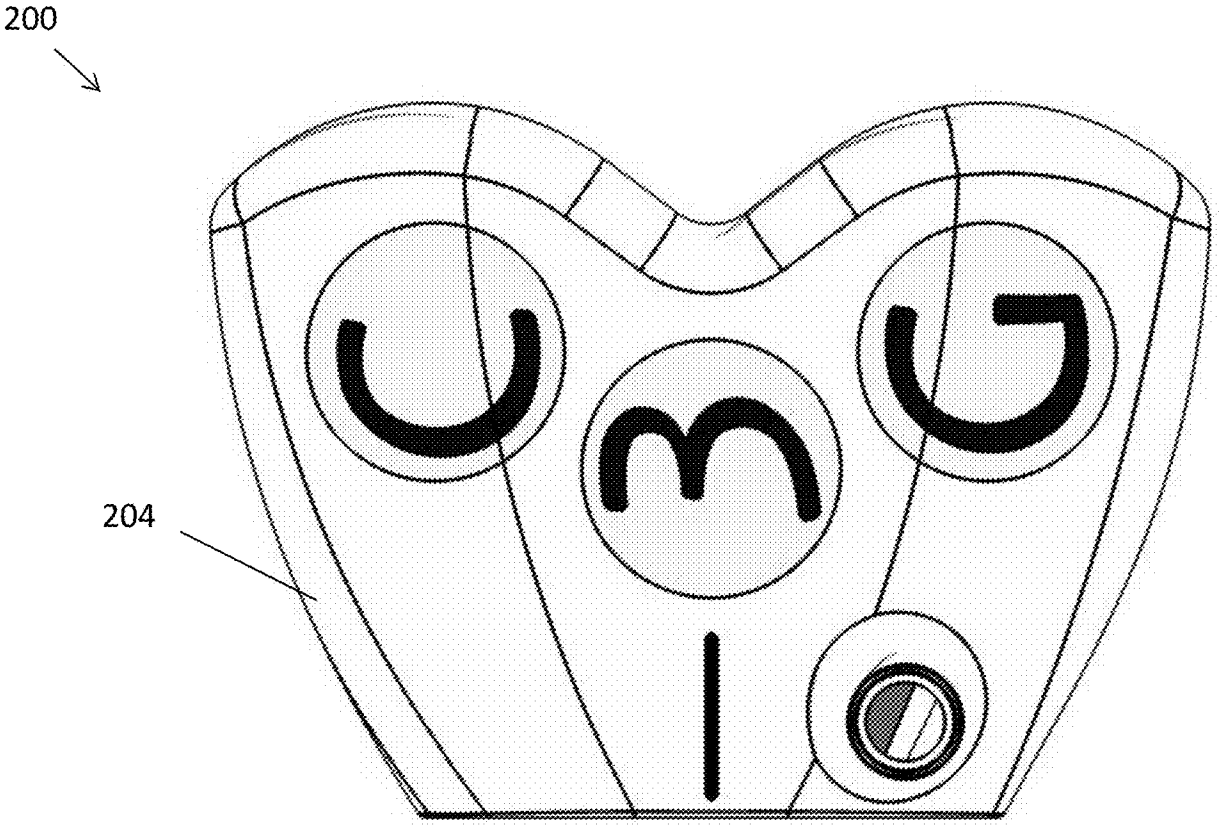
FIG. 15 is a top view of the golf putter head shown in FIG. 9.
Figure 16:
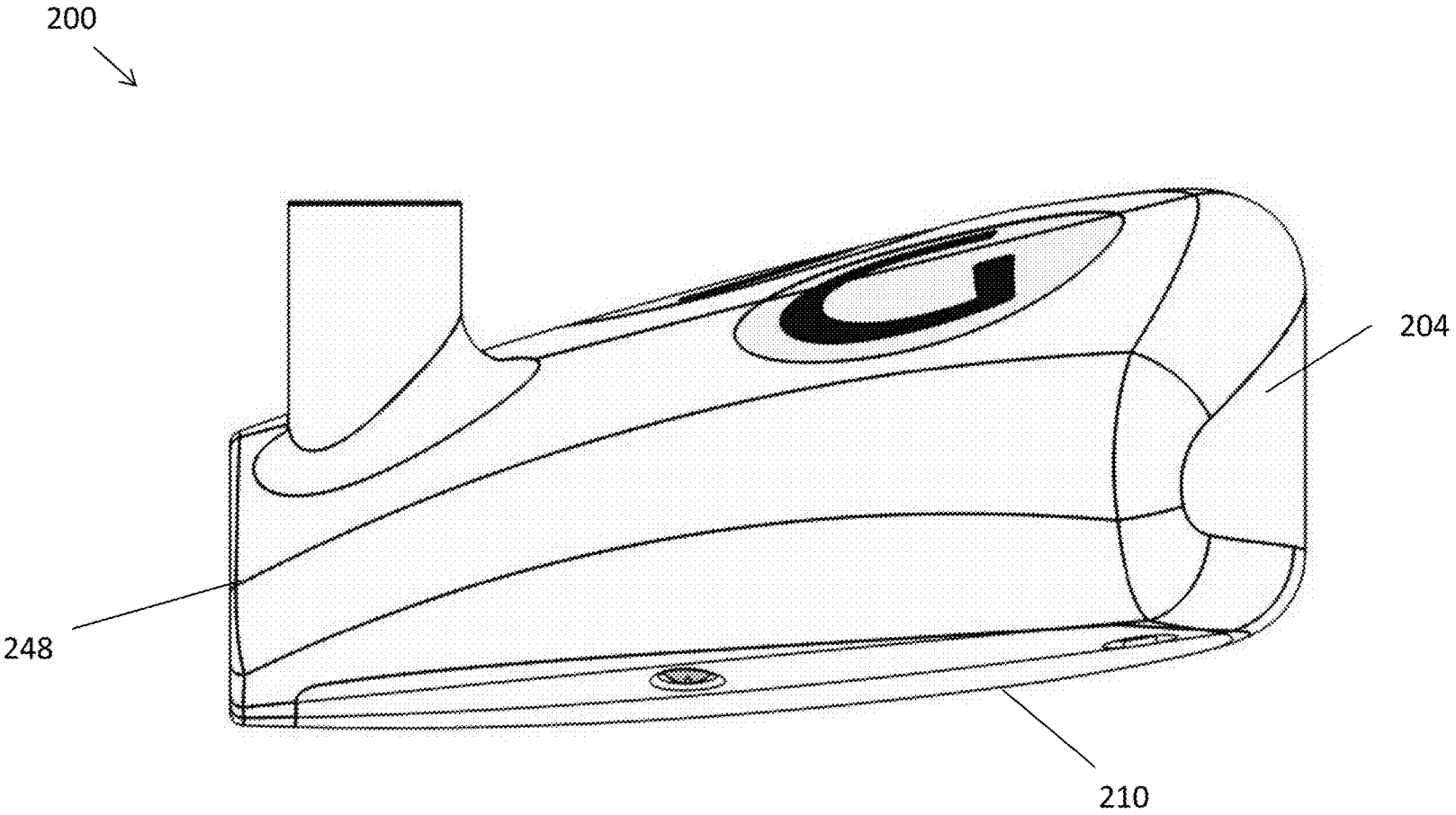
FIG. 16 is a side view of the golf putter head shown in FIG. 9.
Figure 17:
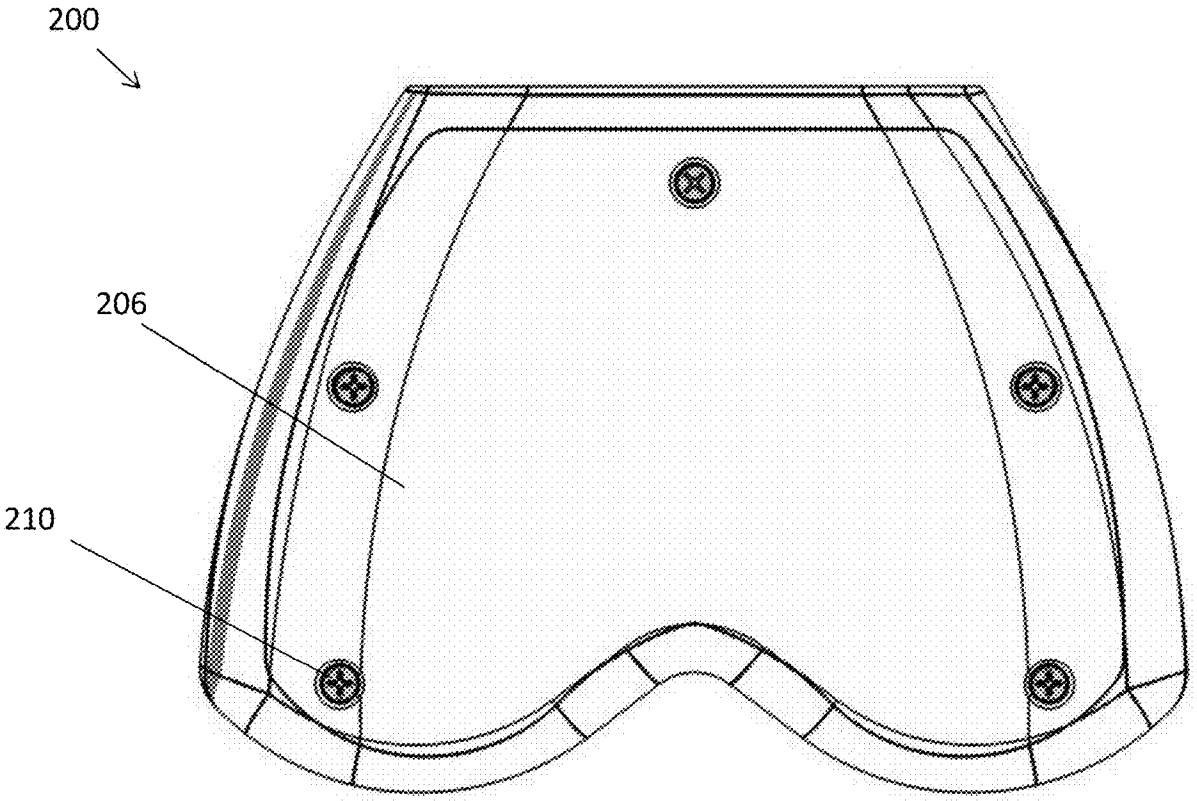
FIG. 17 is a bottom view of the golf putter head shown in FIG. 9.

As shown in FIGS. 11 and 12, a mechanism is attachable to or along an inside surface of the hollow golf putter head 200. The mechanism may comprise a thin-walled bracket 252 configured to be attached (e.g., welded, glued, etc.) internally along or to the inner surface 256 of the portion of the golf putter head 200 that also defines the putter's front impact or striking surface 248. The portion 260 of the bracket 252 that is attachable to the inside surface 256 of the golf putter head 200 may have a shape and size corresponding or complementary to the shape and size of the putter's striking surface 248.

The bracket 252 includes two (or first and second) fingers 264 each having a slot 268 extending (e.g., linearly, etc.) along a portion of the length thereof. The fingers 264 extend outwardly from the bracket portion 260 such that there is an acute angle between the two slotted fingers 264 (e.g., about 30 degrees, etc.). Two (or first and second) dials 272 are respectively coupled to the corresponding the two slotted fingers 264 via mechanical fasteners 274 and the slots 268 such that the dials 272 are slidable along and rotatable relative to the fingers 264.

Each dial 272 may include five pockets 216 (broadly, openings) equally and circumferentially spaced apart from each other along the dial 272. To adjust the overall center of gravity of the golf putter head 200, weight plugs or inserts 220 may be inserted into the pockets 216 at various depths. The pockets 216 may be internally threaded. The outer surface of the weight plugs 220 may be threaded. The threaded weight plugs 220 may include a hexagonal opening or socket such that a hex key or Allen wrench may be used for rotating and threadedly engaging one or more threaded weight plugs 220 into a corresponding one of the threaded pockets 216. Weight plugs 220 may be located at the same depth or at different various depths within the pockets 216.

Each dial 272 may be slid along and rotated relative to the slot 268 of the corresponding slotted finger 264 before the dial 272 is fixed or held in place. The dials 272 may be loosened to allow the dials 272 to be slidably moved up and down the slotted fingers 264 to a chosen position and then tightened and locked into position, to thereby readjust the overall center of gravity of the golf putter head 200.

The bottom portion 206 of the golf putter head 200 is removable and reattachable (e.g., mechanically fastened, etc.) to allow access into the hollow interior 208 of the golf putter head 200. With the bottom portion 206 removed, the golfer may add or remove weight plugs 220 and reposition (rotate or slide) the dials 272 along the corresponding finger 264 to thereby adjust and customize the overall center of gravity of the golf putter head 200 in all 3 X-Y-Z dimensions.

FIGS. 18 through 26 illustrate a third exemplary embodiment of a golf putter head 300 embodying one or more aspects of the present disclosure. The golf putter head 300 includes a hollow body portion 304 defining an interior cavity 308 (FIG. 20) and a removable bottom portion 306. The bottom portion 306 is removably attachable to the body portion 304, e.g., via mechanical fasteners 310 (FIG. 22), etc.

As shown in FIGS. 20 and 21, inserts 372 (e.g., threaded "T" inserts, etc.) are located (e.g., welded, glued, integrally formed, etc.) at a variety of locations along the inside top surface 314 of the golf putter head 300. The inserts 372 include threaded holes 316 (broadly, openings). In this example, five inserts 372 are disposed along the inside top surface 314 of the golf putter head 300. Alternative embodiments may include more or less than five inserts 372.

An array or series of threaded weights 320 of varying length and weight are provided. The threaded weights 320 may include a hexagonal opening or socket such that a hex key or Allen wrench may be used for rotating and threadedly engaging one or more threaded weights 320 into the threaded hole 320 of one of the inserts 316. The golfer may add the threaded weights 320 to the inserts 372 at various locations along the inside top surface 314 of the golf putter head 300 and in various combinations of different weights to thereby adjust and customize the overall center of gravity of the golf putter head 300 in all 3 X-Y-Z dimensions. For example, the golfer may add a single threaded weight 320 to single insert 372. Or, for example, the golfer may add a threaded weight 320 to each of the inserts 372. As yet another example, the golfer may add threaded weights 320 to more than one, but less than all, of the inserts 372.

FIG. 27 show a fourth exemplary embodiment of a golf putter head 400 embodying one or more aspects of the present disclosure. The golf putter head 400 includes a hollow body portion 404 defining an interior cavity 408 and a removable bottom portion 406. The bottom portion 406 is removably attachable to the body portion 404, e.g., via mechanical fasteners, etc.

The body portion 404 includes a top surface 412 having holes 416 (broadly, openings) therein that extend from the top surface 412 into the interior cavity 408. A variety of weight plugs, inserts, or pins 420 (broadly, weights) may be inserted into the holes 416 in the top surface 412 at various positions and in various combinations to influence and thereby adjust and customize the overall center of gravity of the golf putter head 400 in all 3 X-Y-Z dimensions. An array of weight plugs 420 may be provided in different lengths, which changes their weight and influence on the golf putter head's center of gravity.

In this exemplary embodiment, the holes 416 are internally threaded. The outer surface of the weight plugs 420 are also threaded. The threaded weight plugs 420 include hexagonal opening or socket such that a hex key or Allen wrench may be used for rotating and threadedly engaging the threaded weight plugs 420 into the threaded holes 416. The threaded weight plugs 420 may be provided in different weights, or they may each have the same weight.

The holes 416 are disposed within recessed portions 428 along the top surface 416. In this example, the golf putter head 400 includes three recessed portions 428 respectively located adjacent or along the golf putter head's heel portion, middle or centerline portion, and toe portion. Each recessed portion 428 includes five holes 416 equally and circumferentially spaced apart from each other within the corresponding recessed portion 428. Accordingly, the golf putter head 400 includes fifteen different holes 416 each at one of fifteen different locations. By way of example, the golfer may be provided with fifteen weight plugs 420 of the same or different weight in case the golfer wants to add a weight plug 420 to each hole. Or, for example, the golfer may be provided with two or more sets of fifteen weight plugs 420 in different weights.

Caps 432 may be positioned over the recessed portions 428 to thereby cover the weight plugs 420, and any unused holes 416. The caps 432 may be coupled to the top surface 416, e.g., using mechanical fasteners, etc.

The golf putter head 400 also includes a shaft hole 440 and a guide line 144. The guide line 444 is aligned with a center of the striking surface 448. The guide line 444 is also generally perpendicular to the striking surface 448. The guide line 444 provides a visual alignment aid to the golfer.

FIGS. 28 and 29 shows the center of gravity location of the golf putter head 400 after being assembled with three weight plugs 420 in the rearmost pocket or opening 416 of the three recessed portions 428. For comparison purposes, FIGS. 28 and 29 also show the center of gravity location of the golf putter head 400 after being assembled without any weight plugs 420. As shown by FIGS. 28 and 29, the addition of the three weight plugs 420 in the rearmost opening 416 moves the center of gravity rearward (FIG. 28) and upward (FIG. 29). In this example, the three weight plugs 420 weighed a total of about 375 grams.

Also disclosed are exemplary embodiments of methods of adjusting a center of gravity of a golf putter head in all three dimensions. In an exemplary embodiment, a method generally includes adding one or more of a plurality of weights at one or more of a plurality of different available locations along a top surface of the hollow golf putter head. The weights may be provided in different lengths and/or different weights.

In an exemplary embodiment, the weights may comprise weight plugs (e.g., threaded weight plugs, etc.) configured to be inserted (e.g., rotated and threadedly engaged into, etc.) into corresponding openings (e.g., internally threaded openings, etc.) in the top surface of the golf putter head. The openings are located at different locations in or along the top surface of the body, to thereby provide a golfer with different options for adding weight to and/or along the top surface of the golf putter head. In this exemplary embodiment, the method may thus include inserting (e.g., rotating and threadingly engaging, etc.) one or more weight plugs into one or more corresponding openings in the top surface of the golf putter header to thereby adjust the center of gravity of the golf putter head in three dimensions.

In another exemplary embodiment, the weights may comprise weight plugs (e.g., threaded weight plugs, etc.) configured to be inserted into corresponding openings (e.g., internally threaded pockets, etc.) of dials slidably and rotatably supported within the hollow interior or cavity of the golf putter head. The dials may be rotatable and slidable relative to the top surface of the golf putter head to thereby provide the golfer with different options for adding weight to and/or along the top surface of the golf putter head. In this exemplary embodiment, the method may thus include inserting (e.g., rotating and threadingly engaging, etc.) one or more weight plugs into one or more corresponding openings of the dials and rotating and/or sliding the dials to thereby adjust the center of gravity of the golf putter head in three dimensions.

In a further exemplary embodiment, a plurality of inserts (e.g., threaded "T" inserts, etc.) are disposed (e.g., glued, welded, integrally formed, etc.) at different locations along an inside top surface of the golf putter head. The inserts include openings (e.g., threaded openings, etc.) configured for engagement with corresponding weights (e.g., threaded weights of varying lengths and weights, etc.) to thereby provide the golfer with different options for adding weight to and/or along the top surface of the golf putter head. In this exemplary embodiment, the method may thus include inserting (e.g., rotating and threadingly engaging, etc.) one or more weights into one or more corresponding openings of the inserts to thereby adjust the center of gravity of the golf putter head in three dimensions.

Exemplary embodiments disclosed herein may provide one or more (but not necessarily any or all) of the following advantages. For example, a golfer may customize or adjust the center of gravity of the golf putter head in three dimensions by varying the weight placements to "dial out" negative contributors from the putting stroke. A golfer may customize or adjust the center of gravity of the golf putter head to the golfer's specific needs to improve putting stroke and ball performance. With the center of gravity of the golf putter head higher than the center of gravity of the golf ball, impact forces are transmitted over the top of the golf ball causing dramatically sooner rolling versus skipping of the golf ball.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A golf putter head comprising:

a hollow body portion having a top surface; and a plurality of weights configured to be added at a plurality of different available locations along the top surface of the hollow body portion, thereby providing a plurality of different options for adding weight to the golf putter head for adjusting a center of gravity of the golf putter head in three dimensions;

wherein:

the top surface of the hollow body portion includes a plurality of openings that define the different available locations along the top surface;

the weights are configured to be inserted into the openings in the top surface of the golf putter head;

the top surface of the hollow body portion includes first, second, and third recessed portions respectively located adjacent or along a heel portion, a middle portion, and a toe portion of the golf putter head; and the openings in the top surface are disposed within the first, second, and third recessed portions; and wherein the golf putter head further comprises first, second, and third caps configured to positioned over the respective first, second, and third recessed portions, and/or wherein each of the first, second, and third recessed portions includes two or more of the openings equally and circumferentially spaced apart from each other within the corresponding recessed portion.

2. A golf putter head comprising:

a hollow body portion having a top surface; and a plurality of weights configured to be added at a plurality of different available locations along the top surface of the hollow body portion, thereby providing a plurality of different options for adding weight to the golf putter head for adjusting a center of gravity of the golf putter head in three dimensions, wherein:

the golf putter head includes a plurality of dials slidably and/or rotatably supported within a hollow interior of the hollow body portion, the dials including a plurality of openings that define the different available locations along the top surface of the hollow body portion;

the weights are configured to be inserted into the openings in the dials;

the golf putter head includes a striking surface and a bracket having a first portion attached internally along or to an inner surface of a portion of the golf putter head that defines the striking surface;

the bracket includes a plurality of elongate members that extend outwardly from the first portion; and the dials are rotatingly and slidably coupled to corresponding ones of the elongate members.

3. The golf putter head of claim 2, wherein:
each elongate member includes a slot extending along a portion of a length of the elongate member; and
the dials are rotatable and slidable along the slots of the corresponding elongate members.

4. The golf putter head of claim 2, wherein:
the openings of the dials are internally threaded;
the weights include outer threaded surfaces such that the weights are threadingly engageable within the internally threaded openings of the dials; and
each dial includes two or more of the internally threaded openings circumferentially spaced apart from each other.

5. The golf putter head of claim 2, wherein:
the first portion of the bracket has a shape and size complementary to a shape and size of the striking surface; and
the elongate members extend outwardly from the first portion such that an acute angle is defined therebetween.

6. A golf putter head comprising:
a hollow body portion having a top surface;
a bottom portion;
an interior cavity defined between the hollow body portion and the bottom portion; and
a plurality of weights configured to be added at a plurality of different available locations along the top surface of the hollow body portion, thereby providing a plurality of different options for adding weight to the golf putter head for adjusting a center of gravity of the golf putter head in three dimensions;
wherein:
the golf putter head includes a single-piece main body that integrally includes the hollow body portion and the bottom portion, which is integrally attached to or an integral part of the hollow body portion; or
the bottom portion is removably attachable to the hollow body portion; and
the golf putter head includes a main body that includes the hollow body portion and the bottom portion and that has a center of gravity higher than a center of gravity of a golf ball without any of the weights added.

7. The golf putter head of claim 6, wherein:
the top surface of the hollow body portion includes a plurality of openings that define the different available locations along the top surface; and
the weights are configured to be inserted into the openings in the top surface of the golf putter head.

8. The golf putter head of claim 7, wherein:
the openings in the top surface of the hollow body portion are internally threaded; and
the weights include outer threaded surfaces such that the weights are threadingly engageable within the internally threaded openings.

9. The golf putter head of claim 7, wherein:
the top surface of the hollow body portion includes first, second, and third recessed portions respectively located adjacent or along a heel portion, a middle portion, and a toe portion of the golf putter head; and
two or more of the openings in the top surface are disposed within each of the first, second, and third recessed portions.

10. The golf putter head of claim 6, wherein:
a plurality of inserts disposed at different locations along an inside top surface of the hollow body, the inserts include openings that define the different available locations along the top surface of the hollow body; and
the weights are configured to be inserted into the openings of the inserts.

11. The golf putter head of claim 6, wherein:
the golf putter head includes a plurality of openings that define the different available locations, and a plurality of weight holders or sleeves configured to be slidably inserted into the corresponding openings; and
the weights are configured such that one or more of the weights are insertable into any one or more of the weight holders or sleeves for adjusting a center of gravity of the golf putter head in three dimensions.

12. A golf putter comprising the golf putter head of claim 6, coupled to a shaft, wherein the golf putter head includes a material defining the hollow body portion, the bottom portion, and the interior cavity such that the golf putter head is configured to use spring force for putting a golf ball.

13. The golf putter head of claim 12, wherein the material comprises titanium.

14. The golf putter head of claim 6, wherein
the golf putter head includes a striking surface; and
the top surface has a parabolic shape and/or a geometric shape curving upwards from the striking surface.

15. The golf putter head of claim 6, wherein the golf putter head and the weights are configured to allow for adjusting an overall weight of the golf putter head relative to the center of gravity of a golf ball including such that a majority of an overall weight of the golf putter head is higher than the center of gravity of a golf ball when the weights are added along the top surface of the hollow body portion.

16. A golf putter head comprising:
a hollow body portion having a top surface;
a bottom portion;
an interior cavity defined between the hollow body portion and the bottom portion; and
a plurality of weights configured to be added at a plurality of different available locations along the top surface of the hollow body portion, thereby providing a plurality of different options for adding weight to the golf putter head for adjusting a center of gravity of the golf putter head in three dimensions;
wherein:
the golf putter head includes one or more support members slidably and/or rotatably supported within the interior cavity, the one or more support members including a plurality of openings that define the different available locations along the top surface of the hollow body portion;
the weights are configured to be inserted into the openings of the one or more support members; and
the bottom portion of the golf putter head is removable and to allow access into the cavity for adding and removing weights into the openings of the one or more support members and/or for slidably and/or rotatably repositioning the one or more support members within the interior cavity.

17. A golf putter head comprising:
a hollow body portion having a top surface;
a bottom portion;
an interior cavity defined between the hollow body portion and the bottom portion; and
a plurality of weights configured to be added at a plurality of different available locations along the top surface of the hollow body portion, thereby providing a plurality of different options for adding weight to the golf putter head for adjusting a center of gravity of the golf putter head in three dimensions;

wherein the top surface of the hollow body portion includes a plurality of openings that define the different available locations along the top surface, and the weights are configured to be inserted into the openings in the top surface of the golf putter head;

wherein the top surface of the hollow body portion includes one or more recessed portions; and wherein:

each of the one or more recessed portions include two or more of the openings spaced apart from each other within the corresponding recessed portion; and/or the golf putter head further comprises one or more caps configured to be positioned over the respective one or more recessed portions.

* * * * *